US006718872B2

(12) United States Patent
Kanno

(10) Patent No.: US 6,718,872 B2
(45) Date of Patent: Apr. 13, 2004

(54) PRINTER WITH A DUPLEX PRINTING CAPABILITY

(75) Inventor: Hiroshi Kanno, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 10/334,988

(22) Filed: Jan. 2, 2003

(65) Prior Publication Data

US 2003/0127001 A1 Jul. 10, 2003

(30) Foreign Application Priority Data

Jan. 9, 2002 (JP) ..... 2002-002660

(51) Int. Cl.[7] ..... B41L 13/04

(52) U.S. Cl. ..... 101/118; 101/116; 101/231; 101/425

(58) Field of Search ..... 101/116, 117, 101/118, 119, 120, 124, 129, 423, 425, 484, 490, 229, 231, 232

(56) References Cited

U.S. PATENT DOCUMENTS 6,293,193 B1 * 9/2001 Bolza-Schunemann ..... 101/229

FOREIGN PATENT DOCUMENTS

| | | |
|---|---|---|
| JP | 06-071996 | 3/1994 |
| JP | 06-135111 | 5/1994 |
| JP | 08-090893 | 4/1996 |
| JP | 08-142477 | 6/1996 |
| JP | 08-332768 | 12/1996 |

* cited by examiner

*Primary Examiner*—Leslie J. Evanisko
(74) *Attorney, Agent, or Firm*—Oblon, Spivak, McClelland, Maier & Neustadt, P.C.

(57) ABSTRACT

A printer with a duplex printing capability of the present invention includes a printing section. In a duplex print mode, the printing section prints either one of a first and a second image formed in a master side by side on the front side of a first sheet. A path selector steers the first sheet coming out of the printing section toward an auxiliary tray. The printing section prints either one of the first and second images on the front side of a second sheet while refeeding means again feeds the first sheet to the printing section to thereby form either one of the first and second images on the reverse side of the first sheet. The path selector steers the first and second sheets toward a sheet discharging section and the auxiliary tray, respectively.

29 Claims, 11 Drawing Sheets

PRINTER WITH A DUPLEX PRINTING CAPABILITY

BACKGROUND OF THE INVENTION

1. Field of the Invention

The present invention relates to a printer capable of printing images on both sides of a sheet in a single step.

2. Description of the Background Art

A digital, thermal printer using a stencil is extensively used as a simple, convenient printer and includes a thermal head provided with an array of minute heat-generating elements. While a thermosensitive stencil is being conveyed in contact with the thermal head, a current is selectively fed to the heat-generating elements in the form of pulses in accordance with image data, thereby perforating the stencil with heat. After the perforated stencil or master has been wrapped around a porous, cylindrical print drum, a press roller or similar pressing means is pressed against the print drum via a sheet. As a result, ink is transferred from the print drum to the sheet via the perforations of the master, printing an image on the sheet.

Today, duplex printing that prints images on both sides of a sheet is spreading because it reduces the consumption of sheets, the space for storing of documents and so forth. It has been customary to execute duplex printing by passing a sheet fed from a sheet feeding section through a printing section to thereby print an image on one side of the sheet, reversing the sheet, and again passing the sheet through the printing section to thereby print another image on the other side of the sheet. However, it is troublesome to again set the sheet driven out at the sheet feeding section or to arrange consecutive sheets each carrying an image on one side thereof by hand.

Further, when an image is printed on the reverse side of a sheet just after the printing of an image on the front side, the image on the front side, which is still wet, is blurred or otherwise disturbed when various rollers including the press roller contact it. For this reason, the printing of an image on the reverse side is, in many cases, effected on the elapse of several hours since the printing of an image on the front side. This is particularly true with an image including a solid portion having a substantial area. In this manner, the conventional duplex printing scheme needs a long period of time for drying an image printed on one side of a sheet. In addition, duplex printing time is two times as long as simplex printing time because a single sheet must be conveyed via the printing section two times.

In light of the above, Japanese Patent Laid-Open Publication Nos. 6-71996 and 6-135111 each disclose a stencil printer including a first and a second print drum and moving means for selectively causing the two print drums into or out of contact with each other. The stencil printer produces a duplex print in a single step by causing the two print drums to contact with each other with the moving means.

Also, Japanese Patent Laid-Open Publication Nos. 8-90893 and 8-142477 each propose a stencil printer including a first print drum, first pressing means facing the first print drum via a sheet path and movable into and out of contact with the print drum, a second print drum positioned downstream of the first drum in a direction of sheet conveyance and facing the first drum via a sheet path, and second pressing means facing the second print drum via a sheet path and movable into and out of contact with the second drum. To produce a duplex print in a single step, the first drum and first pressing means and the second drum and second pressing means are sequentially caused to contact each other in this order.

Further, Japanese Patent Laid-Open Publication No. 8-332768 teaches a stencil printing method and a stencil printer for practicing the same. The stencil printing method taught in this document produces a duplex print in a single step, which consists of a first and a second step, by use of a master formed with a first and a second image side by side in the direction of rotation of a print drum. In the first step, a press roller is rotated in direct contact with the print drum in synchronism with either one of the first and second images, so that an image corresponding to the first or the second image is transferred from the print drum to the press roller. In the second step, the press roller is rotated in contact with the print drum via a sheet with the other of the first and second images being matched in position to the image present on the press roller. As a result, the image on the press roller is transferred to a first side of the sheet while an image corresponding to the second image is transferred from the print drum to the other side of the sheet.

Laid-Open Publication Nos. 6-71996 and 6-135111 stated above have the following problems left unsolved. The two print drums positioned one above the other are configured to be selectively brought into or out of contact with each other and are done so even in a simplex print mode. In the simplex mode, a perforated, or cut, master and a non-perforated master must be respectively wrapped around the two print drums, resulting in the wasteful consumption of a stencil. Further, when dampers mounted on the two print drums face each other, the print drums must be released from each other. This brings about a problem that when printing speed is high, the area over which the print drums contact each other and therefore an image area decreases. If the outside diameter of each print drum is increased to guarantee a sufficient image area, then not only the size reduction of the printer is obstructed, but also loud noise is produced when the print drums are brought into contact.

Laid-Open Publication Nos. 8-90893 and 8-142477 also have the problem that a non-perforation master must be wrapped around one of the two print drums in a simplex print mode, resulting in the wasteful consumption of a stencil. Another problem is that because the two print drums are serially arranged, the printer is almost two times as large in size as a stencil printer for simplex printing. This is undesirable from the space saving standpoint.

Further, the problem with Laid-Open Publication No. 8-332768 is that image density differs from the front side to the rear side of a sheet because one of the first and second images is directly transferred from the print drum to a sheet while the other image is transferred to the sheet by way of the press roller.

SUMMARY OF THE INVENTION

It is an object of the present invention to provide a printer capable of producing a simplex print in a simplex print mode without wasting a stencil or producing an attractive duplex print in a duplex print mode while occupying a minimum of space.

A printer with a duplex printing capability, of the present invention includes a printing section including a print drum around which a master formed with a first and a second image side by side is to be wrapped and a press roller selectively movable into or out of contact with the print drum. A sheet feeding section feeds sheets toward the printing section one by one. A sheet discharging section discharges a printed sheet coming out of the printing section to the outside of the printer. An auxiliary tray temporarily stops the printed sheet carrying an image on its front side thereof. A refeeding device again feeds the printed sheet temporarily stopped by the auxiliary tray toward the printing section. A path selector selectively steers the sheet coming out of the printing section toward the auxiliary tray or the sheet discharging section. In a duplex print mode, the printing section prints either one of the first and second images on the front side of the first sheet fed from the sheet feeding section. The path selector steers the first sheet coming out of the printing section toward the auxiliary tray. The printing section then prints either one of the first and second images on the front side of the second sheet fed from the sheet feeding section while the refeeding device again feeds the first sheet to the printing section to thereby form either one of the first and second images on the reverse side of the first sheet. The path selector steers the first sheet toward the sheet discharging section and steers the second sheet toward the auxiliary tray.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the printer with a duplex printing capability in accordance with the present invention will be described hereinafter.

First Embodiment

Figure 1:
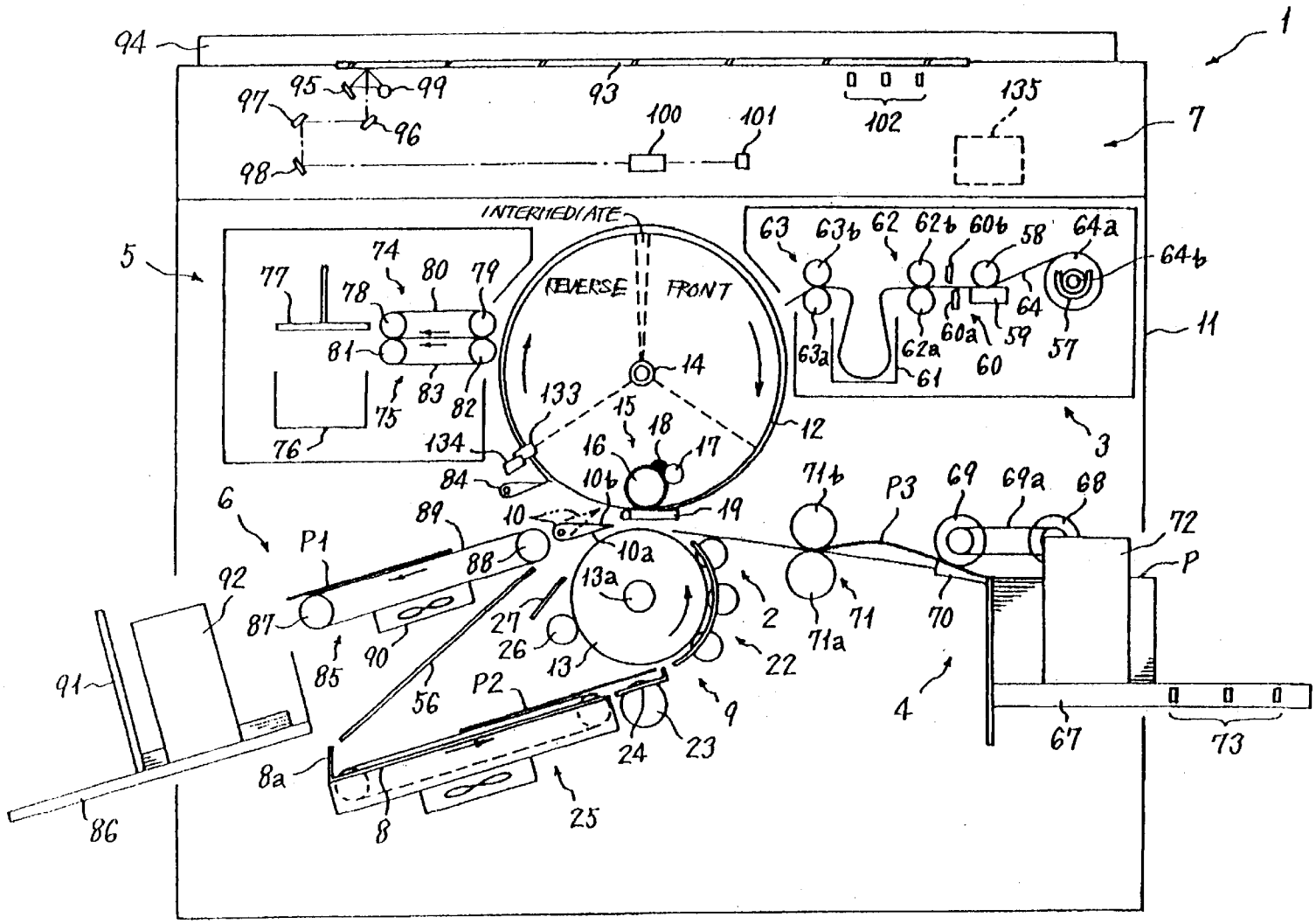
FIG. 1 is a front view showing a first embodiment of the printer with a duplex printing capability in accordance with the present invention.

Referring to FIG. 1 of the drawings, a printer with a duplex printing capability embodying the present invention is shown and generally designated by the reference numeral 1. As shown, the printer 1 is generally made up of a printing section 2, a master making section 3, a sheet feeding section 4, a master discharging section 5, a sheet discharging section 6, an image scanning section 7, a refeeding section 9, and a path selector 10.

The printing section 2 is arranged in and substantially at the center of a housing 11 and includes a print drum 12 and a press roller 13. The print drum 12 includes a pair of flanges, a porous support plate, and a mesh screen although not shown specifically. The flanges are freely rotatably mounted on a hollow shaft 14, which plays the role of an ink feed pipe at the same time. The porous support plate is wrapped around the circumferences of the flanges while the mesh screen is wrapped around the porous support plate. The print drum 12 is caused to rotate by drum drive means 121 (see FIG. 8) and bodily removable from the housing 11. In the illustrative embodiment, the print drum 12 is so sized as to produce a print of up to size A3 in a simplex print mode.

Ink feeding means 15 is arranged inside the drum 12 and includes an ink roller 16 and a doctor roller 17 as well as the shaft 14. The ink roller 16 is journalled to opposite side plates positioned in the print drum 12 and held in contact with the inner periphery of the print drum 12. Drive means, not shown, causes the ink roller 16 to rotate in the same direction as the print drum 12. The doctor roller 17 is also journalled to the above side plates and positioned such that its periphery adjoins the periphery of the ink roller 16. Drive means, not shown, causes the doctor roller 17 to rotate in opposite direction to the print drum 12. A plurality of small holes are formed in the hollow shaft 14. In this configuration, ink fed to the inside of the shaft 14 drops through the holes and forms an ink well 18 in a wedge-shaped space between the ink roller 16 and the doctor roller 17.

A stage is formed on the outer periphery of the print drum 12 and extends in the axial direction of the print drum 12. A damper 19 is positioned on the stage for clamping the leading edge of a master, which will be described later, when the print drum 12 is rotated to a preselected angular position, opening/closing means, not shown, opens and then closes the damper 19.

Figure 2:
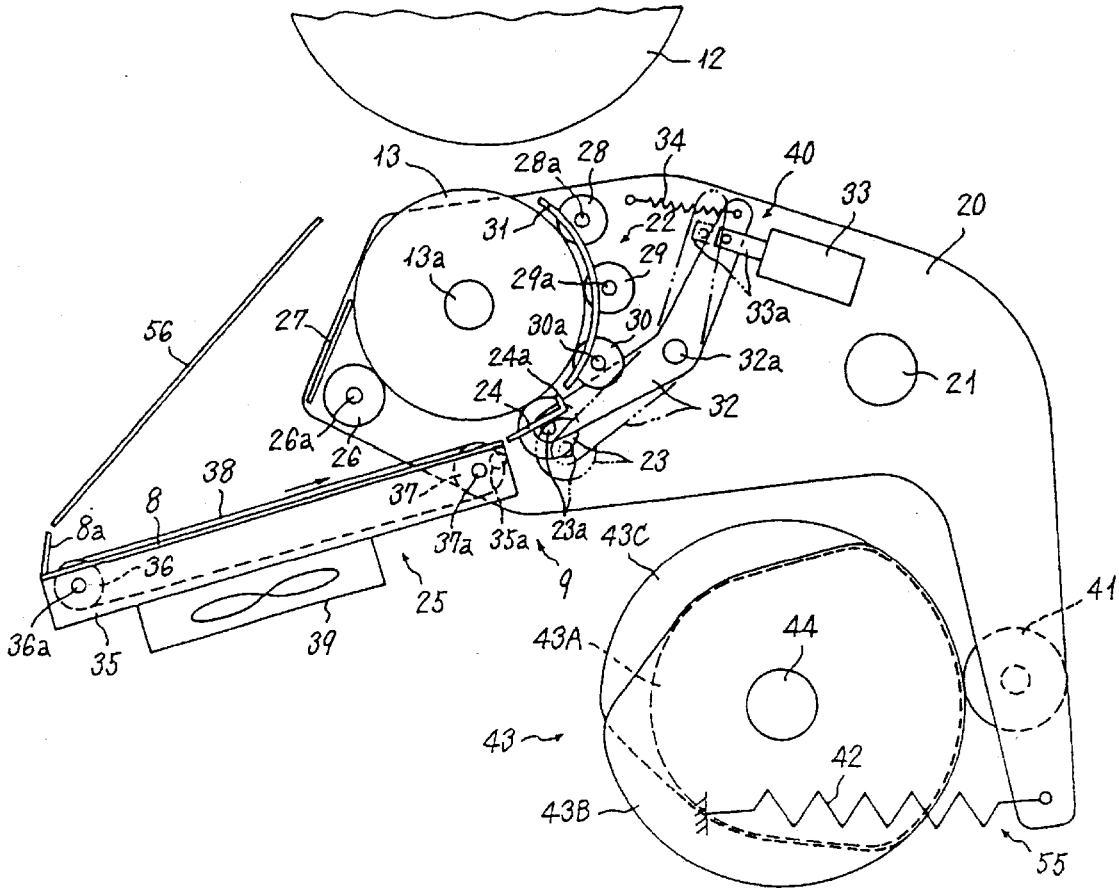
FIG. 2 is a front view showing a press roller included in the first embodiment in a position released from a print drum.

The press roller 13 is positioned below the print drum 12 and extends in the axial direction of the print drum 12. The press roller 13 is made up of a metallic core 13*a* and an elastic layer formed of, e.g., rubber and wrapped around the core 13*a*. As shown in FIG. 2, a pair of generally L-shaped arms, constituting a press roller support member, 20 (only one is visible) rotatably support opposite ends of the core 13*a* of the press roller 13. The arms 20 are interconnected by a shaft 21 in the vicinity of their bent portions. The shaft 21 is journalled to the housing 11. In the illustrative embodiment, at least the surface of the press roller 13 is formed of polytetrafluoroethylene resin or similar ink-repellant material. Also mounted on each arm 20 are a refeed guide member 22, a refeed registration roller or member 23, a refeed positioning member 24, a refeed conveying member 25, a cleaning roller or member 26, and a guide plate 27.

The refeed guide member 22, adjoining the right side of the press roller 13, is made up of a plurality of rollers 28, 29 and 30 and a guide plate 31. The rollers 28, 29 and 30 each are mounted on one of shafts 28*a*, 29*a* and 30*a* and pressed against the press roller 13. The guide plate 31 is so curved as to cause a sheet P to move along the circumference of the press roller 13. The shafts 28*a* through 30*a* are journalled to the arms 20 at their opposite ends and constantly biased by biasing means, not shown, toward the core 13*a*. The rollers 28 through 30 extend over substantially the entire width of the press roller 13 and are spaced from each other by a preselected distance.

The guide plate 31 is spaced from the circumference of the press roller 13 by a preselected distance smaller than the radius of each of the rollers 28 through 30 and is supported by the arms 20 at its opposite ends. The guide plate 31 has a curvature whose center is positioned at the axis of the core 13*a* and is formed with a plurality of openings, so that the rollers 28 through 30 can contact the press roller 13.

The refeed registration roller 23 is positioned below the press roller 13 and freely rotatably mounted on a shaft 23*a*, which is mounted on one end of an angled, angularly movable arm or refeed registration support member 32. The arm 32 is angularly movably mounted on a shaft 32*a*, which is supported by the arms 20, at its bent portion. The arm 32 is positioned such that the refeed registration roller 23 is located at substantially the center in the axial direction of the press roller 13 and such that the arm 32 itself is positioned at the intermediate portion of the segments of the roller 30.

A solenoid 33 is mounted on one of the arms 20 via a bracket, not shown, and has a plunger 33*a* connected to the other end of the arm 32. A tension spring 34 is anchored at one end to one of the arms 20 and at the other end to the above end of the arm 32, constantly biasing the arm 32 counterclockwise, as viewed in FIG. 2, about the shaft 32*a*. When the solenoid 33 is energized, the refeed registration roller 23 is brought to a position indicated by a solid line in FIG. 2 where it is pressed against the press roller 13 by preselected pressure-. When the solenoid 33 is deenergized, the refeed registration roller 23 is brought to a position indicated by a phantom line in FIG. 2 where it is released from the press roller 13 under the action of the tension spring 34. The solenoid 33 and tension spring 34 constitute a refeed registration moving mechanism 40 in combination.

The refeed positioning member 24 is positioned above the refeed registration roller 23 and implemented as a plate having a generally L-shaped section. The refeed positioning member 24 has substantially the same width as the press roller 13 and is affixed to the arms 20 with its end portion 24*a* extending upward. A notch, not shown, is formed in the refeed positioning member 24 so as not to interfere with the refeed registration roller 23 when the roller 23 is angularly moved.

The refeed conveying member 25 is positioned below the press roller 13 at the left-hand side of the refeed positioning member 24. The refeed conveying member 25 includes a box-like frame 35, a drive roller 36, a driven roller 37, an endless belt 38 passed over the drive roller 36 and driven roller 37, and a suction fan 39. An auxiliary tray 8 is positioned above and constructed integrally with the refeed conveying member 25.

The frame 35 is open at its top and has a width slightly smaller than the distance between the arms 20. Bearings, not shown, are mounted on opposite side walls of the frame 35 at the upstream and downstream sides in the direction of sheet conveyance, rotatably supporting a drive shaft 36*a* and a driven shaft 37*a*. The drive shaft 36*a* extends throughout the side walls of the frame 35 and have its opposite ends rotatably supported by bearings, not shown, mounted on the housing 11. A drive gear, not shown, is mounted on one end of the drive shaft 36*a* and operatively connected to a conveyor drive motor 122 (see FIG. 8) mounted on the housing 11. The driven shaft 37*a* does not extend through the side walls of the frame 35. A boss 35*a* is formed on each side wall of the frame 35 at the upstream side in the direction of sheet feed and movably received in a slot, not shown, formed in each arm 20. In this configuration, when a press roller moving mechanism 55, which will be described later, moves the press roller 13 into or out of contact with the print drum 12, the frame 35 is angularly movable about the drive shaft 36*a* in accordance with the movement of the arms 20.

The drive roller 36 mounted on the drive shaft 36*a* is implemented as a plurality of segment rollers spaced from each other by a preselected distance. Likewise, the driven roller 37 mounted on the driven shaft 37*a* is implemented as a plurality of segment rollers spaced from each other by the same distance as the segments of the drive roller 36. The belt 38 is passed over the drive roller 36 and driven roller 37 under preselected tension and formed with a plurality of holes not shown. The conveyor drive motor 122 causes the belt 38 to move in a direction indicated by an arrow in FIG. 2 via the drive shaft 36*a*.

The suction fan 39 is mounted on the bottom of the frame 35 while the auxiliary tray 8 is mounted on the top of the frame 35. The auxiliary tray 8 is formed with a plurality of openings, not shown, in order to allow the belt 38, also implemented as segments, to face a sheet conveying surface. A fence 8*a* extends upward from the downstream end of the auxiliary tray 8 in the direction of sheet conveyance so as to receive the sheet P. An opening is formed in the bottom of the frame 35, so that the fan 39 can negative pressure in the frame 35 for thereby retaining the sheet P on the belt 38. The sucking force of the fan 39 and the frictional resistance of the belt 38 are selected such that when the leading edge of the sheet P contacts the end portion 24*a* of the refeed positioning member 24, slip occurs between the sheet P and the belt 38.

The refeed guide member 22, refeed registration roller 23, refeed positioning member 24 and refeed conveying member 25 constitute the refeeding means 9.

The cleaning roller 26 is positioned in the vicinity of the press roller 13 above the refeed conveying member 25 in order to clean the surface of the press roller 13. The cleaning roller 26 has substantially the same width as the press roller 13 and includes a core 26*a*. At least the surface of the cleaning roller 26 is formed of Japanese pager, sponge or similar highly water-absorptive material. The core 26*a* is received in slots formed in the arms 20, so that the cleaning roller 26 is freely rotatable. Biasing means, not shown, are positioned in the slots of the arms 20 and constantly bias the cleaning roller 26 toward the press roller 13, thereby pressing the cleaning roller 26 against the press roller 13 with preselected pressure. Cleaning roller drive means, not shown, is mounted on one of the arms 20 for causing the cleaning roller 26 to rotate in the same direction as the press roller 13, but at a peripheral speed about one-tenth of the peripheral speed of the press roller 13, when the press roller 13 is rotated.

The guide plate 27 is positioned above and at the left-hand side of the cleaning roller 26. The guide plate 27, affixed to the arms 20 at its opposite ends, guides the sheet P pressed against the print drum 12 by the press roller 13 such that the sheet P moves toward the auxiliary tray 8 without contacting the cleaning roller 26. The guide plate 27 adjoins the press roller 13 and cleaning roller 26, as illustrated.

A rotatable cam follower 41 is mounted on the other end of each arm 20 remote from the press roller 13. A print pressure spring 42 is anchored at one end to the housing 11 and at the other end to each arm 20 in the vicinity of the cam follower 41. Such print pressure springs 42 constantly bias the arms 20 counterclockwise, as viewed in FIG. 2, about the shaft 21.

Figure 4:
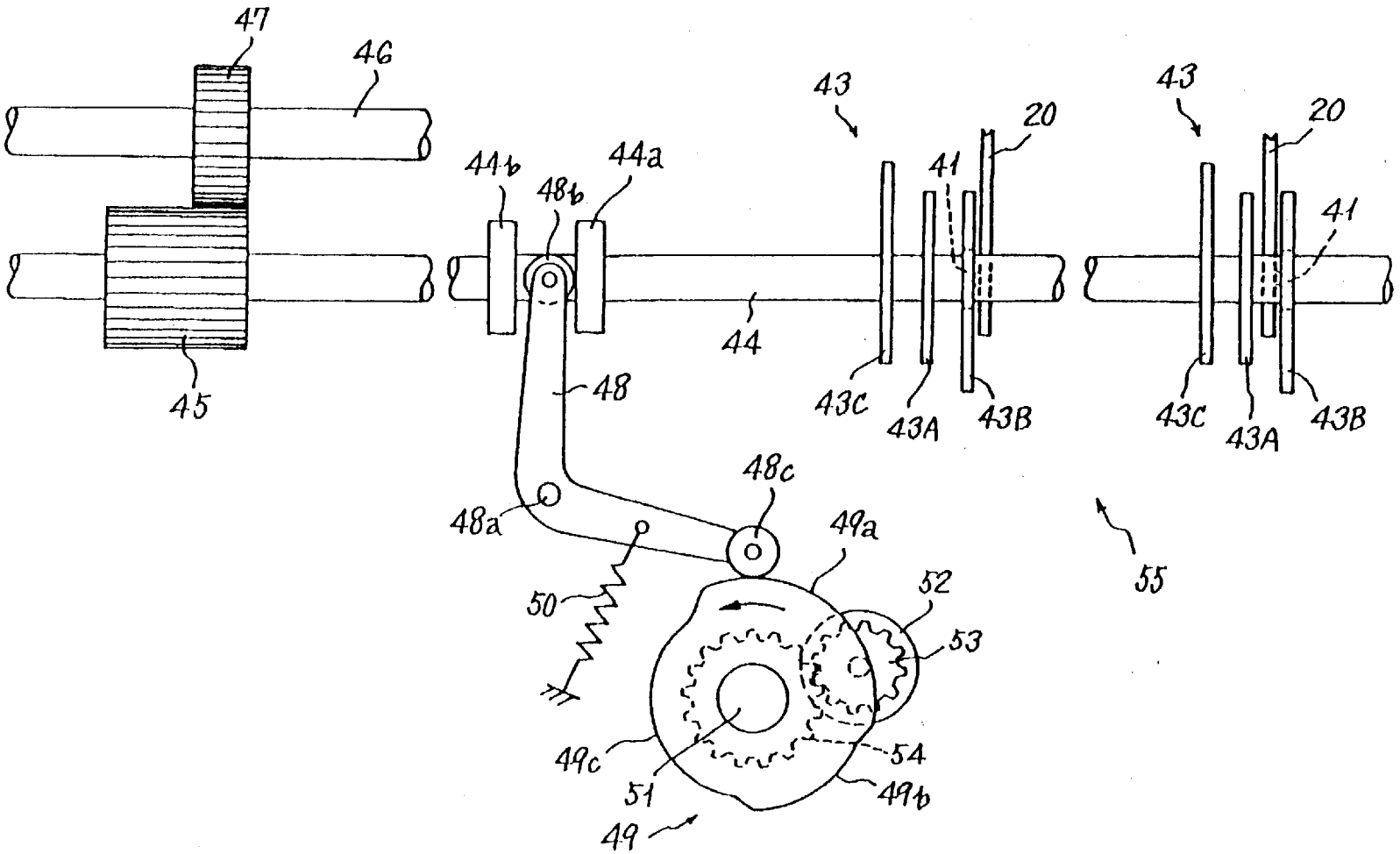
FIG. 4 shows a press roller moving mechanism included in the first embodiment.

A multiple-step cam 43 is positioned at the left-hand side of each cam follower 41 and has three cam plates 43A, 43B and 43C mounted on a cam shaft 44, which is journalled to the housing 11 and freely movable in the direction perpendicular to the sheet surface of FIG. 2. The cam plates 43A through 43C are positioned in this order from the front to the rear and spaced from each other by a preselected distance. The cam plates 43A through 43C each have a disk-like base portion coaxial with the cam shaft 44 and a projection; the projections of the cam plates 43A and 43C are identical in amount with each other. As shown in FIG. 4, a drive gear 45 is mounted on the cam shaft 44 while a transmission gear 47 is mounted on a shaft 46 journalled to the housing 11. The drum drive means 121 causes the cam 43 to rotate clockwise, as viewed in FIG. 2, via the gears 45 and 46.

Figure 3:
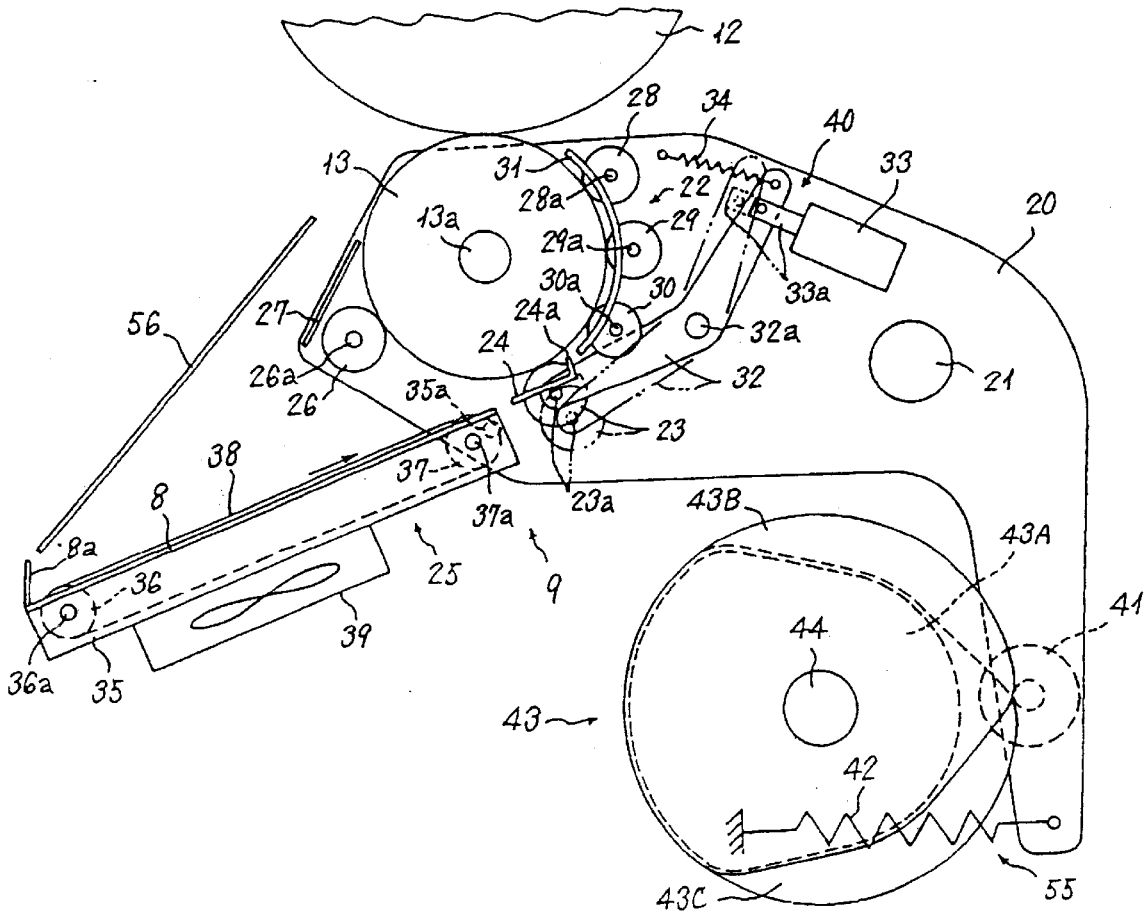
FIG. 3 is a view similar to FIG. 2, showing the press roller in a position pressed against the print drum.

When the projection of any one of the cam plates 43A through 43C is brought into contact with the cam follower 41, the press roller 13 is released from the print drum 12, as shown in FIG. 2. When the projection is released from the cam follower 41, the press roller 13 is pressed against the print drum 12 under the action of the print pressure spring 42, as shown in FIG. 3. The cam plates 43A through 43C each are configured such that its base portion does not contact the cam follower 41 when the press roller 13 is pressed against the print drum 12. The projection of the cam plate 43A is configured to cause the press roller 13 to contact the drum 12 over a range including a front zone, an intermediate zone and a reverse zone shown in FIG. 1. The projection of the cam plate 43B is configured to cause the press roller 13 to contact the drum 12 over the front zone. Further, the projection of the cam plate 43C is configured to caused the press roller 13 to contact the drum 12 over the downstream portion of the cam plate 43C, intermediate zone, and reverse zone. The cam plates 43A through 43C are spaced from each other by a distance sufficiently greater than the thickness of each arm 20.

In FIG. 2, press roller locking means, not shown, is positioned at the right-hand side of the arms 20 for preventing the arms 20 from angularly moving when the press roller 13 is spaced from the print drum 12. More specifically, the press roller locking means includes a solenoid, not shown, for selectively locking or unlocking the arms 20 when energized or deenergized, respectively. The solenoid is operated in the condition wherein the cam follower 41 is held in contact with the projection of any one of the cam followers 43A through 43C.

As shown in FIG. 4, a generally L-shaped arm 48 and a stepped cam 49 are positioned below the cam shaft 44. The arm 48 is mounted on a shaft 48*a*, which is journalled to the housing 11, at its bent portion. A roller 48*b* and a cam follower 48*c* are rotatably mounted on one end and the other end of the arm 48, respectively. A tension spring 50 is anchored at one end to the housing 11 and at the other end to part of the arm 48 intervening between the bent portion and the cam follower 48*c*, constantly biasing the arm 48 clockwise, as viewed in FIG. 4, about the shaft 48*a*.

The roller 48*b* is positioned between disks 44*a* and 44*b* mounted on the intermediate portion of the cam shaft 44 and spaced from each other. The cam follower 48*c* is pressed against the stepped cam 49 by the bias of the tension spring 50. The distance between the disks 44*a* and 44*b* is selected to be slightly greater than the diameter of the roller 48*b*.

The stepped cam 49 has three cam portions 49*a*, 49*b* and 49*c* on its circumference and is mounted on a shaft 51 journalled to the housing 11. A gear 54 is mounted on the shaft 51 and held in mesh with a gear 53 mounted on the output shaft of a stepping motor 52. The stepping motor 52 causes the stepped cam 49 to rotate in a direction indicated by an arrow in FIG. 4. In this configuration, when the stepping motor 52 rotates the stepped cam 49, the arm 48 angularly moves about the shaft 48*a* and causes the roller 48*b* to push the disk 44*a* or 44*b*, thereby causing the cam shaft 44 to move in the right-and-left direction in FIG. 4.

The cam portions 49*a* through 49*c* of the stepped cam 49 are so configured as to move the cam shaft 44 in the following manner. When the cam portion 49*a* of the stepped cam 49 contacts the cam follower 48*c*, the cam plate 43B is moved to a position where it can contact the cam follower 41. When the cam portion 49*b* contacts the cam follower 48*c*, the cam plate 43A is moved to the position where it can contact the cam follower 41. Further, when the cam portion 49*c* contacts the cam follower 48*c*, the cam plate 43C is moved to the position where it can contact the cam follower 41.

The cam follower 41, print pressure spring 42, multiple-step cam 43, press roller locking means, arm 48 and stepped cam 49 constitute the press roller moving mechanism 55. The press roller moving mechanism 55 selectively moves the press roller 13 to the spaced position of FIG. 2 or the contact position of FIG. 3.

As shown in FIG. 1, the path selector 10 is positioned on the sheet conveyance path at the left-hand side of the position where the print drum 12 and press roller 13 contact. The path selector 10 is implemented as a plate having substantially the same width as the print drum 12 and press roller 13 and is mounted on a shaft at its downstream end. This shaft is journalled to the housing 11. A solenoid 123 (see FIG. 8) selectively locates the upstream end of the path selector 10 at a first position indicated by a solid line in FIG. 1 or a second position indicated by a phantom line in FIG. 1. At the first position, the upstream end of the path selector 10 adjoins the press roller 13 and does not interfere with the clamper 19 mounted on the print drum 12. At the second position, the upstream end of the path selector 10 adjoins the print drum 12. The path selector 10, when held in the first position, steers the sheet P coming out of the nip between the print drum 12 and the press roller 13 toward the sheet discharging section 6. The path selector 10, when held in the second position, steers the sheet P toward the auxiliary tray 8 via the path between the guide plate 27 and a guide plate 56 mounted on the housing 11.

The master making section 3 is arranged in the upper right portion of the housing 11 and includes a stencil support member 57, a platen roller 58, a thermal head 59, cutting means 60, a master stocking portion 61, a tension roller pair 62, and a turn roller pair 63. The master making section 3 perforates a stencil 64, which will be described later, to thereby produce a specific master 65 shown in FIG. 5 or a specific master 66 shown in FIG. 6. The master 65 has a first and a second perforated image 65A and 65B while the master 66 has a third perforated image 66A having an area that is the sum of the areas of the first and second images 65A and 65B. The first image 65A is formed such that it corresponds to the front zone of the print drum 12, FIG. 1, when the master 65 is wrapped around the print drum 12. Also, the second image 65A is formed such that it corresponds to the reverse zone of the print drum 12 when the master 65 is wrapped around the print drum 12.

The stencil support member 57 is mounted on each of opposite side walls of the housing 11. The stencil 64 is made up of a thermoplastic resin film and a porous support adhered to each other and implemented as a roll 64*a* rolled on a core 64*b*. The core 64*b* is rotatably, removably supported by the stencil support members 57 at its opposite ends.

The platen roller 57, positioned at the left-hand side of the master support members 57, is journalled to the side walls of the housing 11 and caused to rotate by perforation drive means 124 (see FIG. 8) including a stepping motor. The thermal head 59, positioned beneath the platen roller 58, has a number of heat-generating elements and is supported by the side walls of the housing 11. Biasing means, not shown, constantly presses the heating surface of the thermal head 59 against the platen roller 58. The thermal head 59 causes its heat-generating elements to selectively generate heat in contact with the thermoplastic resin film of the stencil 64, thereby perforating or cutting the stencil 64.

The cutting means 60, positioned at the left-hand side of the platen roller 58 and thermal head 59, is made up of a stationary edge 60*a* affixed to the housing 11 and a movable edge 60*b* movably supported by the stationary edge 60*a*. The movable edge 60*b* rotates relative to the stationary edge 60*a* to thereby cut the stencil 64 at a preselected length.

The master stocking section 61, positioned downstream of the cutting means 60 in the direction of stencil feed, forms a space for temporarily accommodating the master 65 or 66. The master stocking portion 61 is divided into a plurality of chambers by plates. A suction fan is disposed in one of the chambers located at the deepest position. The suction fan generates negative pressure in the master stocking portion 61, which is a closed space, so that the master 65 or 66 is introduced into the master stocking portion 61 toward the deepest chamber.

The tension roller pair 62, positioned between the cutting means 60 and the master stocking portion 61, is made up of a drive roller 62*a* and a driven roller 62*b* journalled to the side walls of the housing 11. Biasing means, not shown, presses the driven roller 62*b* against the drive roller 62*a*. The perforation drive means 124 rotates the drive roller 62*a* and thereby causes the drive roller 62*a* and driven roller 62*b* to convey the stencil 64 while nipping it therebetween. The drive roller 62*a* is rotated at a slightly higher peripheral speed than the platen roller 58 and has a torque limiter thereinside, applying preselected tension to the stencil 64.

The turn roller pair 63, positioned downstream of the master stocking portion 61 in the direction of stencil feed, is made up of a drive roller 63*a* and a driven roller 63*b* journalled to the side walls of the housing 11. The perforation drive means 124 rotates the drive roller 63*a* and thereby causes the drive roller 63*a* and driven roller 63*b* to convey the stencil 64 while nipping it therebetween. A one-way clutch, not shown, is included in the drive roller 63*a*.

A movable stencil guide plate, not shown, is positioned between the tension roller pair 62 and the turn roller pair 63 and angularly movably supported by a support member not shown. A solenoid, not shown, selectively moves the movable stencil guide plate to an operative position where the upper surface of the plate forms a conveyance path or an inoperative position where the plate does not obstruct the entry of the stencil 64 in the master stocking portion 61.

The sheet feeding section 4, positioned below the master making section 3, includes a tray 67, a pickup roller 68, a separator roller 69, a separator pad 70, and a registration roller pair 71. The tray 67 is loaded with a stack of sheets P and supported by the housing 11 in such a manner as to be movable up and down. Sheet feed drive means 125 (see FIG. 8) causes the tray 67 to move up and down. The tray 67 is sized to allow sheets P of size A3 stacked thereon in a profile position. A pair of side fences 72 (only one is visible) are mounted on the upper surface of the tray 67 and movable along rails in the widthwise direction of the sheets P perpendicular to the direction of sheet feed. A plurality of size sensors 73 are positioned on the free-end side of the tray 67 for sensing the size of the sheets P stacked on the tray 67.

The pickup roller 68, positioned above the tray 67, has its surface implemented by a member having high frictional resistance. The pickup roller 68 is journalled to a bracket, not shown, angularly movably supported by the housing 11. When elevating means, not shown, raises the tray 67, the top sheet P on the tray 67 is brought into contact with the pickup roller 68. The pickup roller 68 is driven by the sheet feed drive means 125.

The separator roller 69 and separator pad 70, located at the left-hand side of the pickup roller 68, each have its surface implemented by a member having high frictional resistance. The separator roller 69 is operatively connected to the pickup roller 68 by a timing belt 69*a* and rotated in synchronism with and in the same direction as the pickup roller 68. Biasing means, not shown, presses the separator pad 70 against the separator roller 69.

The registration roller pair 71, positioned at the left-hand side of the separator roller 69 and separator pad 70, is made up of a drive roller 71*a* and a driven roller 71*b*. The output torque of the drum drive means 121 is transferred to the drive roller 71*a* via drive transmitting means, not shown, including gears and a cam. The drive roller 71*a* is caused to rotate at a preselected timing synchronous to the print drum 12 and cooperates with the driven roller 71*b* to convey the sheet P toward the printing section 2.

The master discharging section 5, positioned above and at the left-hand side of the printing section 2, includes an upper and a lower discharging member 74 and 75, a waste master box 76, and a compressor 77. The upper discharging member 74 includes a drive roller 78, a driven roller 79, and an endless belt 80. Master discharge drive means 126 (see FIG. 8) rotates the drive roller 78 clockwise, as viewed in FIG. 1, for thereby moving the belt 80 in a direction indicated by an arrow in FIG. 1. Likewise, the lower discharging member 75 includes a drive roller 81, a driven roller 82, and an endless belt 83. The drive of the master discharge drive means 126 is transferred to the drive roller 81 via drive transmitting means, so that the drive roller 81 rotates counterclockwise, as viewed in FIG. 1, and causes the belt 83 to move in a direction indicated by an arrow in FIG. 1. Moving means, not shown, is included in the master discharge drive mans 126 and selectively moves the lower discharging member 75 to a position shown in FIG. 1 or a position where part of the belt 83 passed over the driven roller 82 contacts the print drum 12.

The waster master box 76 for storing waste or used masters is removably mounted to the housing 11. The compressor 77 is supported by the housing 11 in such a manner as to be movable up and down and driven by elevating means, not shown, included in the master discharge drive means 126. The compressor 77 compresses a waste or used master conveyed by the upper and lower discharging members 74 and 75 into the waste master box 76.

The sheet discharging section 6, located below the master discharging section 5, includes a plurality of peelers 84 (only one is visible), a conveying member 85, and a print tray 86.

The peelers 84 are mounted on a shaft angularly movably supported by the housing 11 and are spaced from each other in the widthwise direction of the drum 12. Peeler moving means, not shown, selectively moves the peelers 84 to a position where the tips of the peelers 84 adjoin the drum 12 or a position where they are retracted from the print drum 12 for avoiding the damper 19. The drive of the drum drive means 121 is transferred to the peeler moving means via drive transmitting means, not shown, so that the peelers 84 angularly move in synchronism with the print drum 12.

The conveying member 85 is positioned below the peelers 84 at the left-hand side of the path selector 10 and includes a drive roller 87, a driven roller 88, a belt 89, and a suction fan 90. The drive roller 87 is implemented as segment rollers mounted on a shaft journalled to unit side walls, not shown, and spaced from each other by a preselected distance. Sheet discharge drive means 127 (see FIG. 8) cause the segment rollers to rotate integrally with each other. The driven roller 88 is also implemented as segment rollers mounted on a shaft, not shown, journalled to the unit side walls and spaced from each other by the same distance as the segments of the drive roller 87. The belt 89 is implemented as segment belts each being passed over one of the segment drive rollers 87 and corresponding one of the segment driven rollers 88. Each segment belt 89 is formed with a plurality of holes. The suction fan 90 is positioned below the drive roller 87, driven roller 88 and belt 89. The sheet P is conveyed in a direction indicated by an arrow in FIG. 1 in accordance with the rotation of the drive roller 87 while being retained on the belt 89 by the suction fan 90. The conveying member 85 drives the sheet or print P out of the housing 11 onto the print tray 86.

The print tray 86 includes an end fence 91 movable in the direction of sheet conveyance and a pair of side fences 92 movable toward or away from each other in the widthwise direction of the sheet P.

The image scanning section 7 is positioned on the top of the housing 11 and includes a glass platen 93 on which a document is to be laid. A cover plate 94 is openable away from the glass platen 93. Mirrors 95, 96, 97 and 98 and a lamp 99 read an image by illuminating the document. Imagewise reflection from the document is focused by a lens 100 on a CCD (Charge Coupled Device) or similar image sensor 101. A plurality of document size sensors 102 sense the size of the document. Image data representative of the document image is written to an image memory 135. Scanning drive means 128 (see FIG. 8) effects such scanning operation.

As shown in FIG. 1, a dog 133 is mounted on the circumference of the flanges included in the print drum 12. A home position sensor 134 is mounted on the housing 11 in the vicinity of the drum 12. When the print drum 12 is rotated to a position where the damper 19 faces the press roller 13, the home position sensor 134 senses the dog 133 and feeds its output to control means 129, which will be described later.

Figure 7:
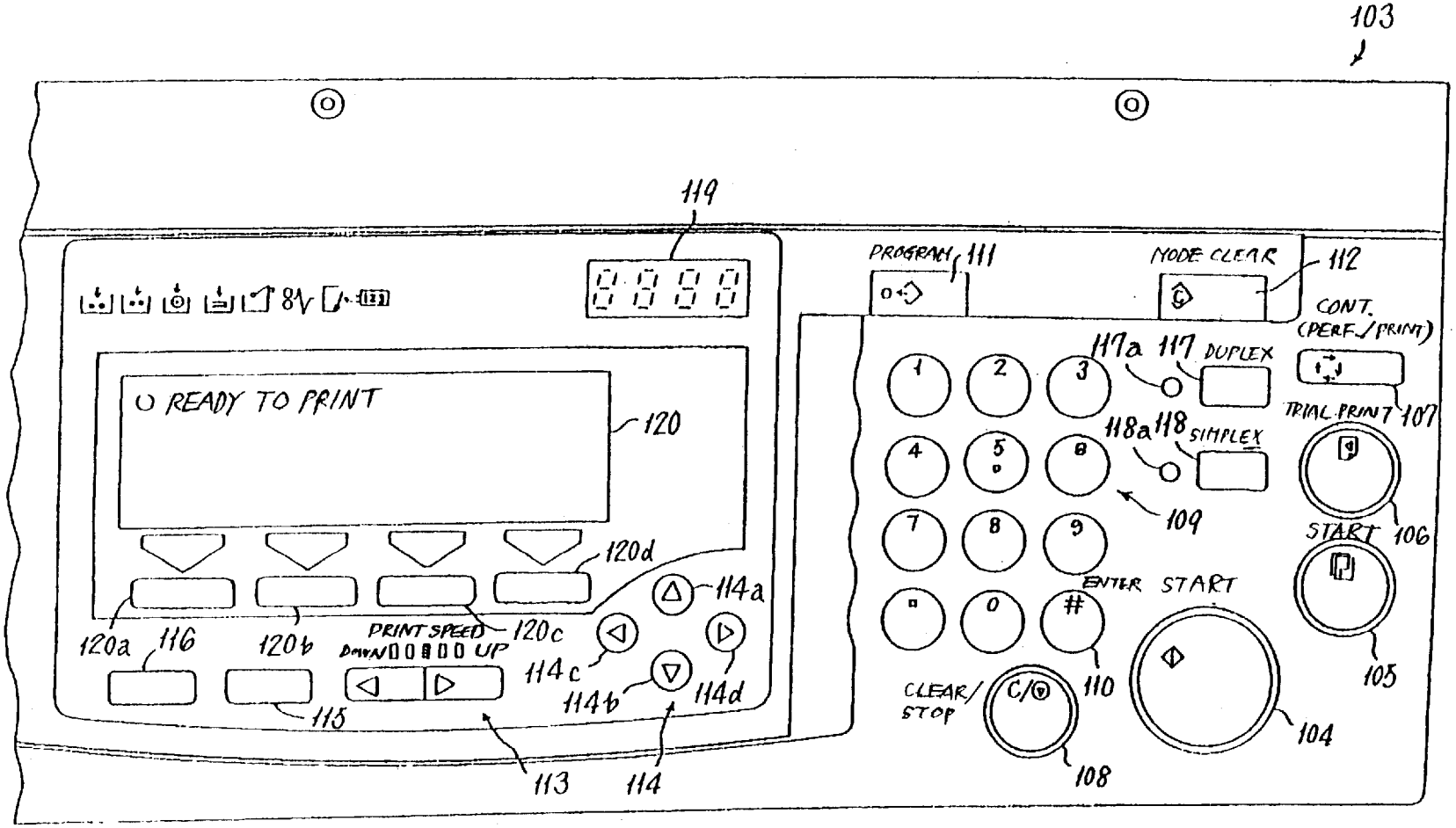
FIG. 7 shows a specific configuration of an operation panel included in the first embodiment.

FIG. 7 shows a specific configuration of an operation panel 103 mounted on the top front part of the housing 11. As shown, the operation panel 103 includes a perforation start key 104, a print start key 105, a trial print key 106, a continuous key 107, a clear/stop key 108, numeral keys 109, an enter key 110, a program key 111, a mode clear key 112, print speed keys 113, direction keys 114, sheet size key 115, a sheet thickness key 116, a duplex print key 117, a simplex print key 118, an indicator 119 implemented by segment LEDs (Light Emitting Diodes), and an LCD (Liquid Crystal Display) 120.

When the operator presses the perforation start key 104, the printer 1 performs a master discharging operation and an image scanning operation and then performs a master wrapping operation. In this condition, the operator inputs various printing conditions and then presses the print start key 105. In response, the printer 1 performs a printing operation. When the operator, input the various printing conditions, presses the trial print key 106, the printer 1 produces a single trial print. When the operator presses the continuous key 107 before the perforation start key 104, the printer 1 continuously performs the master discharging operation, image scanning operation, master making operation and printing operation in this order.

The clear/stop key 108 may be pressed to interrupt the operation of the printer 1 under way or to clear a numerical value input. The numeral keys 109 are used to input numerical values. The enter key 110 is used to set, e.g., numerical values at the time of setting while the program key 111 is used to register or call operations of frequent use. The mode clear key 112 is may be pressed to clear various modes input. The print speed keys 113 are used to lower the print speed for increasing image density when ambient temperature is low or to raise the print speed for reducing image density when ambient temperature is high. The direction keys 114 are an up key 114*a*, a down key 114*b*, a left key 114*c*, and a right key 114*d*.

The sheet size key 115 may be pressed to input a desired sheet size. A sheet size selected on the sheet size key 115 has priority over a sheet size sensed by the sheet size sensors 73. The sheet thickness key 116 is used to input the thickness of the sheets P to be used in a duplex copy mode; in the illustrative embodiment, any one of a plain sheet, a thin sheet and a thick sheet may be selected.

When the operator, intending to obtain a duplex print, presses the duplex print key 117 before the perforation start key 104, an LED 117*a* adjacent the key 117 turns on to show the operator that the duplex print mode has been set. In the duplex mode, the printer 1 invalidates the operation of the perforation start key 104 until the operator inputs the thickness of the sheets P to use on the sheet thickness key 116. When the operator, intending to obtain a simplex print, presses the simplex print key 118 before the perforation start key 104, an LED 118*a* adjacent the key 118 turns on to show the operator that the simplex print mode has been set. The printer 1 initially sets the simplex mode while turning on the LED 118*a*.

The indicator 119 mainly displays the number of prints produced and other numerical values. The LCD 120 has a hierarchical display structure. By pressing any one of setting keys 120*a* through 120*d* positioned below the LCD 120, as viewed in FIG. 7, the operator is capable of selecting various modes including a magnification mode and a position adjustment mode. Further, the LED 120 displays the status of the printer 1, e.g., a message "Ready to print." shown in FIG. 7 as well as other messages indicative of a master jam, a sheet jam, and a stencil, ink or similar supply command.

Figure 8:
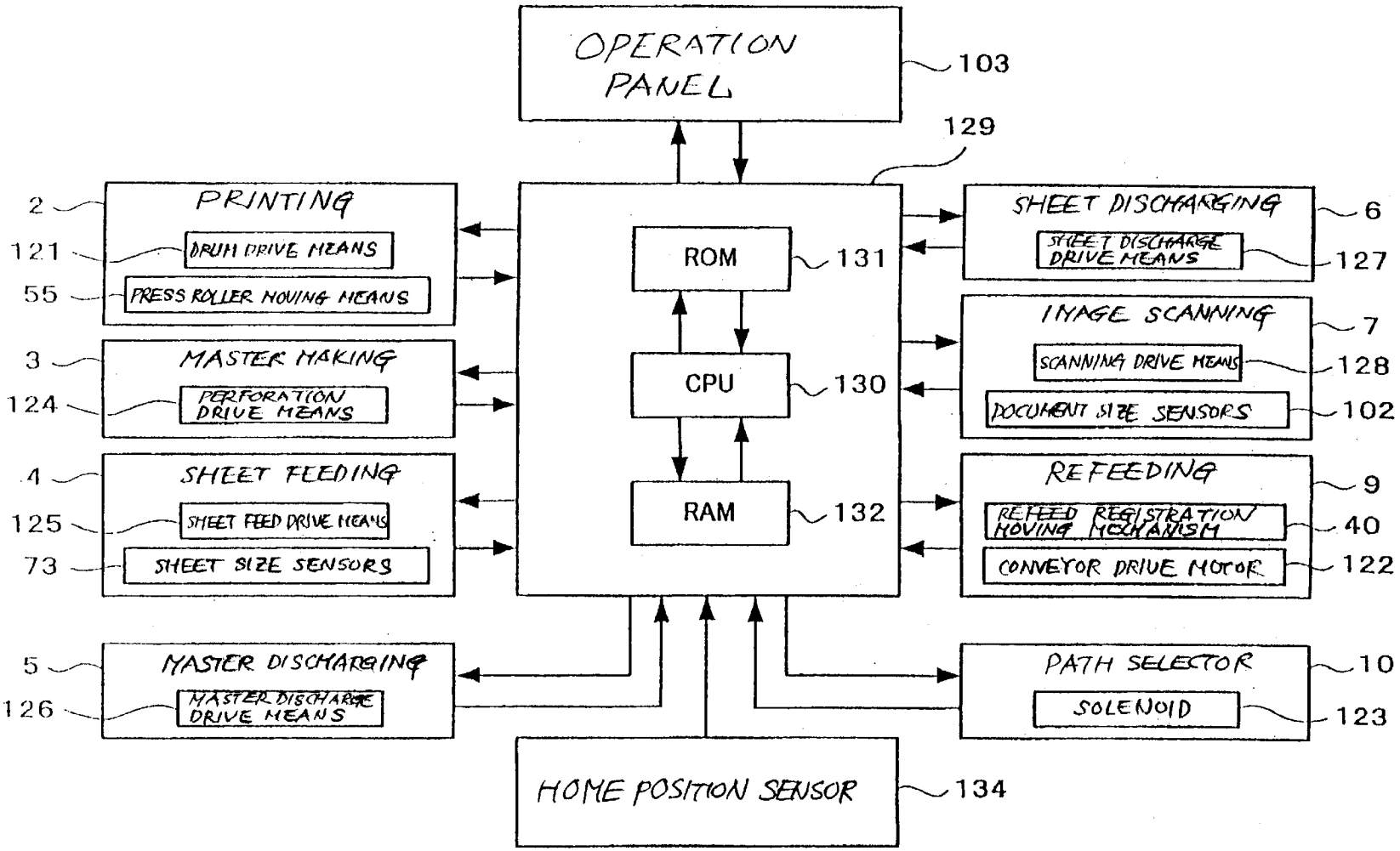
FIG. 8 is a schematic block diagram showing a control system included in the first embodiment.

FIG. 8 shows a control system included in the illustrative embodiment. As shown, the control system includes control means 129 implemented as a conventional microcomputer including a CPU (Central Processing Unit) 130, a ROM (Read Only Memory) 131 and a RAM (Random Access Memory) 132 and disposed in the housing 11.

The CPU 130 controls the operation of the entire printer 1. More specifically, the CPU 130 controls the drive means included in the printing section 2, master making section 3, sheet feeding section 4, master discharging section 5, sheet discharging section 6 and image scanning section 7, the refeed registration moving mechanism 40 and conveyor drive motor 122 included in the refeeding means 9 and the solenoid 123 assigned to the path selector 10 in accordance with signals fed from the operation panel 103, outputs of various sensors mounted on the housing 11, and a program read out of the ROM 131. The program stored in the ROM 131 is read out by the CPU 130, as needed. The RAM 132 plays the role of a work area for the CPU 130. The control means 129 additionally determines the position of the print drum 12 in accordance with a home position signal output from the home position sensor 134 and a signal output from an encoder, not shown, included in the drum drive means 121.

The operation of the printer 1 will be described hereinafter. The operator of the printer 1 stacks the sheets P on the tray 67, opens the cover plate 94 to lay a desired document on the glass platen 93, and then closes the cover plate 94. After setting desired print conditions on the operation panel 103, the operator presses either one of the duplex print key 117 and simplex print key 118 and then presses the perforation start key 104. First, assume that the operator selects the simplex print mode on the simplex print key 118.

After seeing the turn-on of the LED 118*a* assigned to the simplex print mode, the operator presses the perforation start key 104. In response, the sheet size sensors 73 and document size sensors 102 send their outputs to the control means 129. The control means 129 compare the outputs of the sensors 73 and those of the sensors 102 to see if the sheet size and document size are identical or not. If the sheet size and document size are identical, then the control means 129 causes the image scanning operation to start immediately. If the two sizes are not identical, then the control means 129 displays a message showing the operator the non-coincidence. When the sheet size and document size are different, the control means 129 may send a command for automatically executing magnification change or image rotation to thereby match the two sizes.

When the operator presses the perforation start key 104, the image scanning section 7 scans the document with the lamp 99, mirrors 95–98, lens 100, and image sensor 101. An electric signal output from the image sensor 101 is input to an A/D (Analog-to-Digital) converter, not shown, disposed in the housing 11 and then written to the image memory 135 as image data.

In parallel with the image reading operation, the master discharging section 5 performs the master discharging operation, i.e., removes a used master wrapped around the print drum 12. More specifically, on the operation of the perforation start key 104, the print drum 12 starts rotating. When the print drum 12 reaches the home position shown in FIG. 1, the home position sensor 134 senses the dog 133 and sends a home position signal to the control means 129. In response, the control means 129 starts counting encoder pulses. When the control means 129 determines, based on the encoder pulses, that the leading edge of a used master present on the print drum 12 has reached a preselected discharge position corresponding to part of the belt 83 passed over the drive roller 82, the control means 129 stops the operation of the drum drive means 121.

When the drum drive means 121 stops operating and stops the print drum 12 at the master discharge position, the drum drive means 121 and master discharge drive means 126 are operated to rotate the drive rollers 78 and 81 and move the lower discharge member 75 toward the print drum 12. As a result, part of the belt 83 passed over the driven roller 82 is brought into contact with the used master present on the print drum 12. The rotation of the print drum 12 and the movement of the belt 83 cooperate to lift the used master away from the print drum 12. Subsequently, the lower discharge member 75 cooperates with the upper discharge member 74 to peel off the used master from the print drum 12. The used master so removed from the print drum 12 is introduced in the waster master box 76 and then compressed by the compressor 77.

Even after the removal of the used master, the print drum 12 is continuously rotated until it reaches a preselected master waiting position where the damper 19 is positioned at the upper right portion of the print drum 12. When the print drum 12 stops rotating at the master waiting position, the opening/closing means opens the damper 19 away from the stage of the print drum 12. In this condition, the printer 1 waits for the feed of a master.

In parallel with the master discharging operation, the master making section performs the master making operation. More specifically, when the operator presses the perforation start key 104, the platen roller 58, tension roller pair 62 and turn roller pair 63 are rotated to pull out the stencil 64 from the roll 64*a*. At this instant, the movable master guide plate is located at its conveying position. When the image forming area of the stencil 64 is brought to a position corresponding to the heat-generating elements of the thermal head 59, the image data stored in the image memory 135 and processed are read out and fed to a thermal head driver not shown. The thermal head driver causes the heat-generating elements of the thermal head 59 to selectively generate heat in accordance with the image data, thereby forming the third perforation image 66A in the thermoplastic resin film of the stencil 64. As soon as the leading edge of the stencil 64 being so perforated is nipped by the turn roller pair 63, the movable master guide plate is retracted while the turn roller 63 is caused to stop rotating.

The platen roller pair 58 and tension roller pair 62, continuously rotating even after the stop of rotation of the turn roller pair 63, convey the perforated part of the stencil 64, i.e., the master 66 into the master stocking portion 61. At the time when the turn roller 63 stops rotating, the suction fan of the master stocking portion 61 starts operating to smoothly suck the master 66 into the master stocking section 61.

When the printer 1 reaches the stand-by state after the completion of the master discharging operation while the master making operation is under way, the turn roller pair 63 starts rotating to convey the master 66 toward the damper 19 out of the master stocking portion 61. When the leading edge of the master 66 reaches a preselected position, the opening/closing means closes the damper 19 and causes it to retain the leading edge on the print drum 12.

Subsequently, the print drum 12 is intermittently rotated clockwise, as viewed in FIG. 1, so that the master 66 is wrapped around the print drum 12. At this instant, the turn roller pair 63 is in a halt while the drive roller 63*a* is rotated by the master 66 being pulled out via the one-way clutch thereof. As soon as the image data from the image memory 135 ends, the thermal head 59 stops operating, completing the master 66. At this time, the platen roller 58, tension roller pair 62 and turn roller pair 63 are caused to stop rotating while the cutting means 60 is operated to cut off the master 66. The master 66 so cut off is pulled out of the master making section 3 by the print drum 12 in rotation. The master making and feeding step ends when the print drum 12 reaches its home position.

The master feeding operation is followed by a master sticking operation. More specifically, when the print drum 12 is brought to a stop at the home position, the solenoid 123 moves the path selector 10 to the first position. Subsequently, the press roller locking means is operated while the stepping motor 52 is driven to rotate the stepped cam 49 to a position where the cam portion 49*b* contacts the cam follower 48*c*. As a result, the arm 48 is angularly moved about the shaft 48*a* to move the cam shaft 44 to the position where the cam plate 43A is capable of contacting the cam follower 41. Thereafter, the press roller locking means stops operating.

In the above condition, the pickup roller 68, separator roller 69, drive roller 87 and suction fan 90 are driven while the print drum 12 is rotated clockwise, as viewed in FIG. 1, at a low speed. As a result, the top sheet P on the tray 67 is paid out until its leading edge abuts against the nip of the registration roller pair 71. At the time when the leading edge, in the direction of rotation of the print drum 12, of the master 66 present on the drum 12 reaches a position where it faces the press roller 12, the drive roller 71*a* is driven to convey the sheet P toward the position between the print drum 12 and the press roller 13.

In the press roller moving mechanism 55, the cam shaft 44 and multiple-step cam 43 are driven in synchronism with the rotation of the print drum 12, so that the cam plate 43A capable of contacting the cam follower 41 is rotated to move its projection away from the cam follower 41 at the preselected timing mentioned above. As a result, the press roller 13 is pressed against the print drum 12 under the action of the print pressure spring 42, pressing the sheet P against the master 66 on the print drum 12. Consequently, the ink applied from the ink roller 16 to the inner periphery of the print drum 12 is transferred to the sheet P via the pores of the holes of the print drum 12, porous support plate and mesh screen forming the print drum 12, and the porous support and perforations of the master 66, thereby sticking the master 66 to the print drum 12.

The sheet to which an image corresponding to the third image 66A is transferred by the above sticking operation is steered by the path selector 10 toward the sheet conveying member 85 while being peeled off from the master 66 by the peeler 84. The sheet P then drops onto the sheet conveying member 85 and then discharged to the print tray 86 by the belt 89 while being sucked by the suction fan 90. Subsequently, the print drum 12 is again rotated to the home position and stopped there, completing the master sticking operation. In this condition, the printer 1 remains in a stand-by state until the printing operation begins.

Assume that after the printer 1 has reached the stand-by state, the operator inputs desired printing conditions on the operation panel 103 and then presses the trial print key 106. Then, the print drum 12 is caused to rotate at a desired input printing speed while one sheet P is fed from the sheet feeding section 4. The sheet P is conveyed via the registration roller pair 71 to the position between the print drum 12 and the press roller 13 and then pressed against the master 66 wrapped around the drum 12 in exactly the same manner as during master sticking operation. The resulting trial print P is also driven out to the print tray 86 via the path selector 10, peeler 84, and sheet conveying member 85.

If the trial print is acceptable as to the position, density and so forth of the image, then the operator inputs a desired number of prints on the numeral keys 109 and then presses the print start key 105. In response, the sheets P are continuously fed from the sheet feeding section 4 and processed in the same manner as the trial print. When the desired number of prints are fully output, the print drum 12 is stopped at the home position, and the printer. 1 again waits in the stand-by position.

Assume that the operator presses the duplex print key 177 to select the duplex print mode. Then, after seeing the turn-on of the LED 117*a*, the operator presses the sheet thickness key 116 to select the thickness of the sheets P to use. In the duplex print mode, an input on the perforation start key 104 is invalidated unless the operator presses the sheet thickness key 116. More specifically, if the operator presses the perforation start key 104 without pressing the sheet thickness key 116, then the control means 129 displays a message urging the operator to set desired sheet thickness on the LCD 120. In the illustrative embodiment, when the operator selects a plain sheet or a thin sheet on the sheet thickness key 116, an input on the perforation start key 104 is accepted. However, when the operator selects a thick sheet, an input on the perforation start key 104 is rejected in order to obviate a sheet jam while a message urging the operator to select correct sheets appears on the LCD 120. At this instant, the LCD 120 plays the role of first display means.

Assume that the operator sets plain sheets or thin sheets P on the tray 67, selects sheet thickness corresponding to the sheets P on the sheet thickness key 116, and then presses the perforation start key 104. Then, the control means 129 compares the outputs of the sensors 73 and 102 in the same manner as in the simplex print mode. In the illustrative embodiment, the maximum sheet size applicable to the print drum 12 is A3, so that the maximum sheet size available in the duplex print mode is A4 landscape. If the document size and sheet size are identical, then the control means 129 effects the image scanning operation immediately. However, if the two sizes are not identical, the control means 129 displays an alarm message on the LCD 120, as stated earlier. At this instant, the LCD 120 plays the role of second display means. If the sheet size is larger than size A4 landscape, then the control means 129 inhibits the duplex print mode and displays a message urging the operator to select the simplex mode on the LCD 120.

When the operator presses the perforation start key 104, the image scanning section 7 scans the first document image as in the simplex print mode. The resulting image data is written to the image memory 135 as first image data. Subsequently, the control means 129 displays a message urging the operator to replace the first document with the second document on the LCD 120. The operator, watching the message, opens the cover plate 94, removes the first document from the glass platen 93, lays the second document on the glass platen 93, and then closes the cover plate 94. When a sensor, not shown, senses the cover plate 94 closed and when a sensor, not shown, senses the document on the glass platen 93, the image scanning section 7 scans the second document. The resulting image data is written to the image memory 135 as second image data.

In the illustrative embodiment, the operator is expected to lay a desired document on the glass platen 93 by opening and closing the cover plate 94 by hand in both of the simplex and duplex print modes, as stated above. Alternatively, an ADF (Automatic Document Feeder) may be used to automatically convey documents to the glass platen 93. Further, image data may be received from a host located outside of the printer 1. In addition, in the duplex print mode, a single document may be reversed and then conveyed so as to produce two pages of image document from the opposite sides of the document.

Figure 5:
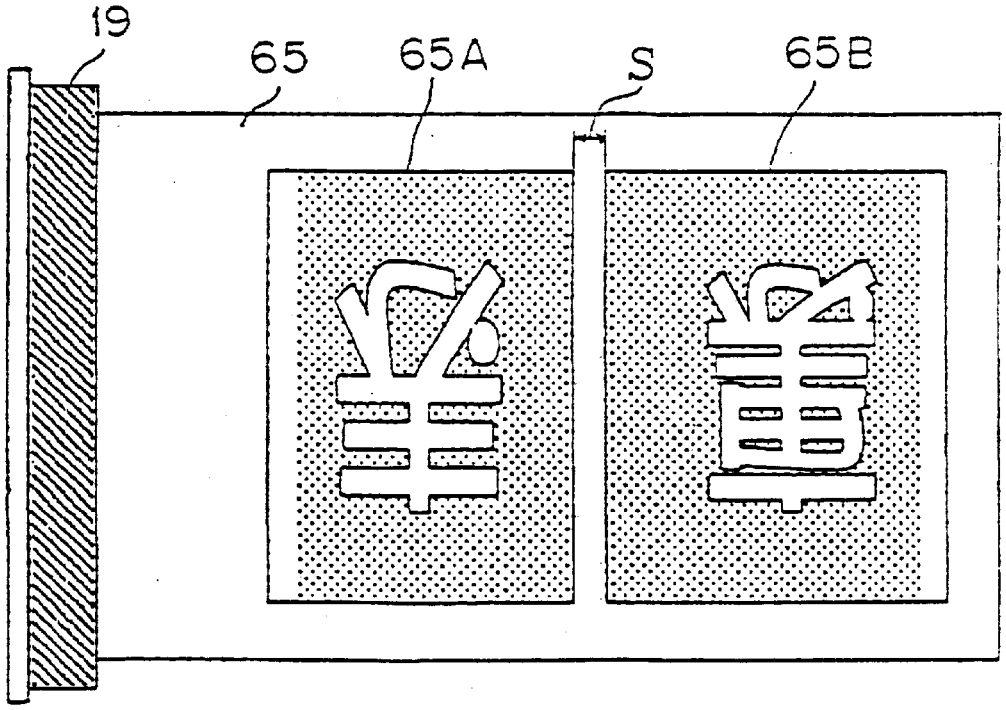
FIGS. 5 and 6 each show a particular specific master used in the first embodiment.
Figure 6:
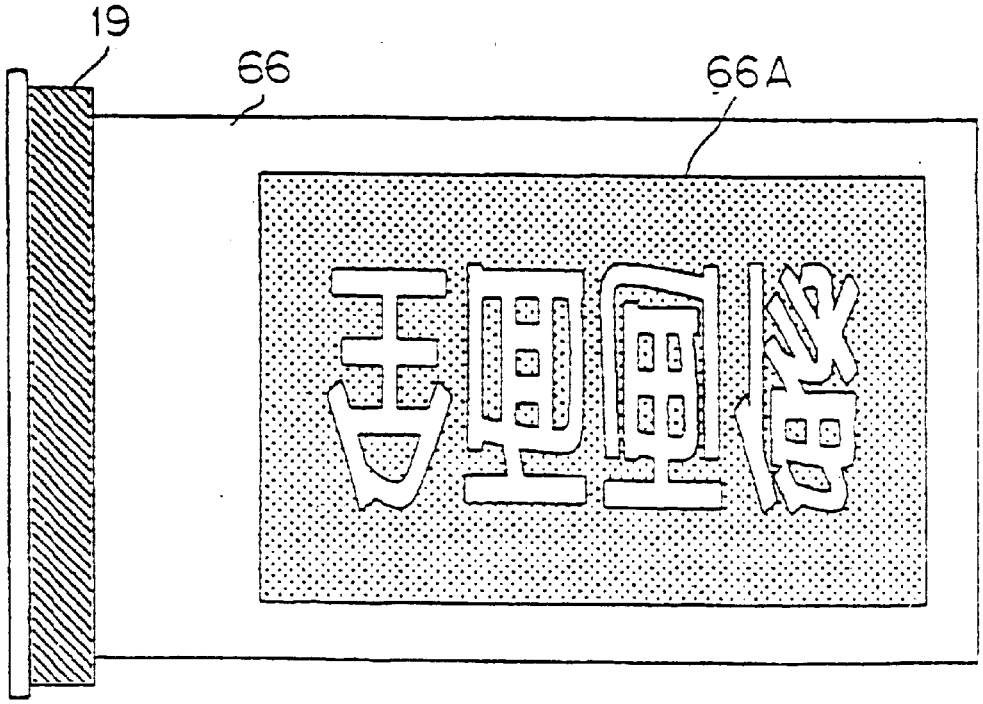

In parallel with the image scanning operation, the master discharging section 5 discharges a used master as in the simple print mode. After the removal of the used master, the print drum 12 is brought to a stop at the master waiting position, and then the opening/closing means opens the clamper 19. In parallel with the master discharging operation, the master making section 3 performs the master making operation in the same sequence as in the simplex print mode except that the first and second images 65A and 65B are sequentially perforated in the thermoplastic resin film of the stencil 64. As shown in FIG. 5, the first and second images 65A and 65B are spaced from each other by a preselected blank portion S. The blank portion S meets the intermediate zone of the print drum 12, FIG. 1, when the master 65 is wrapped around the print drum 12. The master 65 with the two images 65A and 65B is temporarily stored in the mater stocking portion 61. When the printer 1 reaches the stand-by state after the master discharging operation, the master 65 is conveyed toward the clamper 19 by the turn roller pair 63. Subsequently, the print drum 12 is intermittently driven as in the simplex print mode, so that the master 65 is wrapped around the print drum 12. After the image data has been fully output from the image memory 135, the cutting means 60 is operated to cut off the master 65. The master 65 is then pulled out of the master making section 3 by the rotation of the print drum 12. Subsequently, the print drum 12 is brought to a stop at the home position, completing the master making and feeding operations.

The master feeding operation is followed by the master sticking operation. More specifically, when the print drum 12 stops at the home position, the stepping motor 52 is driven to rotate the stepped cam 49 while the press roller locking means is operated to cause the cam portion 49*a* to contact the cam follower 48*c*. As a result, the arm 48 is angularly moved about the shaft 48*a* to move the cam shaft 44 to the position where the cam plate 42*b* is capable of contacting the cam follower 41. Thereafter, the press roller locking means stops operating.

Subsequently, the pickup roller 68, separator roller 69, drive rollers 36 and 87 and suction fans 39 and 90 are driven while the print drum 12 is rotated clockwise, as viewed in FIG. 1 at the low speed. At the same time, the first sheet P1 is paid out until its leading edge has been nipped by the registration roller pair 71. After the damper 19 has moved away from the position corresponding to the damper 10, the solenoid 123 is energized to move the path selector 10 to the second position. Thereafter, the drive roller 71*a* is driven at a preselected timing at which the leading edge of the first image 65A in the direction of rotation of the print drum 12 reaches the press roller 13, thereby conveying the sheet P1 toward the position between the print drum 12 and the press roller 13.

At the above timing, the cam plate 43B capable of contacting the cam follower 41 causes its projection to move away from the cam follower 41 with the result that the press roller 13 is pressed against the print drum 12 under the action of the print pressure spring 42. It follows that the press roller 13, sheet P1, first image 65A and print drum 12 are pressed against each other, transferring the ink from the print drum 12 to the sheet P1 in the same manner as in the simplex print mode. In this manner, part of the master 65 where the first image 65A is present is stuck to the print drum 12.

The sheet P1 with an image corresponding to the first image 65A is steered by the path selector 10 held in the second position toward the refeeding means 9 while being sequentially peeled off from the master 65. The sheet P1 steered downward by the path selector 10 abuts against the fence 8*a* of the auxiliary tray 8 via the path between the guide plates 27 and 56 and then laid on the auxiliary tray 8. The belt 38 conveys the sheet P1 laid on the auxiliary tray 8 in a direction indicated by an arrow in FIG. 1 with the suction fan 39 sucking the sheet P1 until the leading edge of the sheet P1 (trailing edge during printing of the first image 65A) abuts against the end portion 24*a*. In this condition, the sheet P1 and belt 38 slip on each other, and therefore the sheet P1 is stopped with its leading edge abutting against the end portion 24*a*. If desired, a sensor, not shown, responsive to the leading edge of the sheet P1 maybe provided for interrupting the operation of the drive roller 36 and that of the suction fan 39 when the sensor senses the leading edge of the sheet P1.

Even when the sheet P1 is being guided to the auxiliary tray 8, the print drum 12 is continuously rotated. The press roller 13, after completing its contact with the front zone of the print drum 12, is released from the print drum 12 because the projection of the cam plate 43B contacts the cam follower 41. The cam plate 43B prevents the reverse zone of the print drum 12 and the press roller 13 from contacting each other without the intermediary of the sheet P, so that the transfer of the ink to the press roller 13 is obviated. At this instant, the press roller locking means is operated to lock the press roller 13 at the released position. Subsequently, the stepping motor 52 is driven to rotate the stepped cam 49 until the cam portion 49*b* contacts the cam follower 48*c*. As a result, the arm 48 is angularly moved about the shaft 48*a* to move the cam shaft 44 to the position where the cam plate 43A is capable of contacting the cam follower 41.

At substantially the same time as the above operation, the pickup roller 68 and separator roller 69 are driven to feed the send sheet P2 toward the registration roller pair 71. The drive roller 71*a* of the registration roller pair 71 is driven at the previously stated preselected timing to convey the second sheet P2 to the position between the print drum 12 and the press roller 13.

On the other hand, in the press roller moving mechanism 55, when the cam shaft 44 is rotated to a position where the projection of the cam plate 43A is capable of contacting the cam follower 41, the press roller locking means stops operating. At this instant, the print drum 12, rotating in synchronism with the cam shaft 44, faces the press roller 13 at its non-porous zone other than the front zone, reverse zone and intermediate zone. Also, the solenoid 123 is energized between the time when the front zone of the print drum 12 moves away from the press roller 13 and the time when the damper 19 again faces the path selector 10, switching the path selector 10 from the second position to the first position.

At the time when the registration roller pair 71 starts conveying the sheet P2, the projection of the cam plate 34A is released from the cam follower 41 with the result that the press roller 13 is pressed against the print drum 12 under the action of the print pressure spring 42. More specifically, the press roller 13, sheet P2, first image 65A of the master 65 and print drum 12 are pressed against each other, so that the ink is transferred to the sheet P2, forming an image corresponding to the first image 65A on the sheet P2.

The sheet P2 with the above image is steered by the path selector 10 held in the first position toward the sheet conveying member 85 while being peeled off from the master 65 by the peeler 84. The sheet P2 so peeled off drops onto the sheet conveying member 85 and conveyed to the print tray 86 thereby.

After the registration roller pair 71 has conveyed the sheet P2, the solenoid 33 is energized at a preselected timing slightly earlier than the time when the leading edge of the second image 65B of the master 65 in the direction of rotation of the print drum 12 faces the press roller 13, causing the arm 32 to move clockwise, as viewed in FIG. 2, about the shaft 32*a*. Consequently, the refeed registration roller 23 is moved from the released position to the contact position and causes the sheet P1 abutting against the end portion 24*a* to contact the press roller 13, which is being rotated by the print drum 12.

The sheet P1, contacted the press roller 13, is conveyed by the press roller 13 to the downstream side in the direction of rotation of the roller 13. The sheet P1 is then conveyed toward the nip between the print drum 12 and the press drum 13 by the guide plate 31 and rollers 28 through 30 in close contact with the press roller 13. Although the sheet P1 carries the image corresponding to the first image 65A of the master 65 on its front side, the refeed guide member 22 maintains the sheet P1 in close contact with the press roller 13. Therefore, the sheet P1, contacting the press roller 13 is prevented from being shifted, so that image defects including blurring and line thickening are obviated. After the trailing edge and intermediate portion of the sheet P2 have moved away from the position corresponding to the press roller 13, the sheet P1 is brought to the nip between the print drum 12 and the press roller 13 at the time when the leading edge of the reverse zone arrives at the press roller 13.

Consequently, the press roller 13, sheet P1, second image 65B of the master 65 and print 12 are pressed against each other. In this condition, the ink is transferred from the print drum 12 to the sheet P1 via the second image 65B, so that the portion of the master 65 formed with the second image 65B is stuck to the print drum 12.

The sheet P1 carrying the image corresponding to the first image 65A and image corresponding to the second image 65B on its front and reverse sides, respectively, is steered by the path selector 10 held in the first position toward the sheet conveying member 85. The sheet P1 peeled off from the master 65 drops onto the sheet conveying member 85 and conveyed to the print tray 86 thereby, completing the master sticking operation. The printer 1 then waits in the stand-by state.

The blank portion S between the first and second images 65A and 65B of the master 65 forms the intermediate zone on the print drum 12 when the master 65 is wrapped around the print drum 12. This prevents the trailing edge of the sheet P2 fed from the sheet feeding section 4 and the leading edge of the sheet P1 refed from the refeeding means 9 from overlapping each other. The image surface of the sheet P1 refed from the refeeding means 9 contacts the press roller 13, causing the ink to be again transferred from the sheet P1 to the press roller 13. However, because the surface of the press roller 13 is ink-repellent and because the cleaning roller 26 cleans it, the transfer of ink from the sheet P1 to the press roller 13 is reduced while the removal of the ink from the press roller 13 is promoted. Therefore, the retransfer of the ink from the press roller 13 to the reverse side of the sheet P is obviated during successive printing.

Assume that in the stand-by state of the printer 1 the operator inputs desired printing conditions on the print speed key 113 and other various keys and then presses the trial print key 106. In this case, too, if the operator selects a thick sheet, then the control means 129 urges the operator to set correct sheets by displaying the previously stated message.

When the trial print key 106 is pressed, the cam shaft 44 is moved to the position where the cam plate 43B is capable of contacting the cam follower 41 as during the master sticking operation. Subsequently, the print drum 12 is driven at an input print speed while the path selector 10 is switched to the second position as during the master sticking operation. After the start of rotation of the print drum 12, one sheet P1 is fed from the sheet feeding section 4 to the registration roller pair 71. The sheet P1 is then conveyed by the registration roller pair 71 at the same timing as during the master sticking operation and pressed against the first image 65A of the master 65 by the press roller 13. The sheet P1 carrying an image corresponding to the first image 65A is steered by the path selector 10 toward the auxiliary tray 8. Subsequently, the belt 38 conveys the sheet P1 with the suction fan 39 sucking the sheet P1, so that the sheet P1 is stopped by the end portion 24*a*.

Subsequently, the press roller locking means is operated to lock the press roller 13 in the released position while the stepped cam 49 is rotated to shift the cam shaft 44 to the position where the cam plate 43A is capable of contacting the cam follower 41. The press roller locking means then stops being operated. The path selector 10 is switched from the second position to the first position before the damper 19 again faces the path selector 10. At substantially the same time, the second sheet P2 is fed from the sheet feeding section 4 to the registration roller pair 71 and then conveyed by the roller pair 71 toward the printing section 2 at the same timing as the first sheet P1.

In the printing section 2, the press roller 13 presses the sheet P2 against the first image 65A of the master 65 to thereby form a corresponding image on the front side of the sheet P2. The sheet P2 with the image is steered by the path selector 10 held in the first position toward the sheet conveying member 85. The sheet P2 is peeled off from the master 65 by the peeler 84 and drops onto the sheet conveying means 85. The sheet conveying means 85 conveys the sheet P2 to the print tray 86.

After the registration roller pair 71 has conveyed the sheet P2, the solenoid 33 is energized at the same timing as during the master sticking operation in order to move the refeed registration roller 23 from the released position to the contact position. As a result, the sheet P1 held in a halt is pressed against the press roller 13 in rotation and conveyed thereby. The sheet is therefore conveyed toward the printing section 2 while being held in close contact with the press roller 13 by the refeed guide member 22.

The press roller 13 presses the sheet P1 against the second image 65B of the master 65, so that an image corresponding to the second image 65B is formed on the sheet P1. The sheet P1 carrying the images on both sides is steered by the path selector 10 toward the sheet conveying member 85. Subsequently, the sheet P1 is peeled off from the master 65 by the peeler 84 and then conveyed to the print tray 86 by the sheet conveying means 85. This is the end of the trial printing operation.

Assume that the operator, confirmed the position, density and so forth of the images formed by trial printing, inputs a desired number of prints on the numeral keys 109, and then presses the print start key 105. In response, the printing operation begins. Again, if the operator selects a thick sheet, then the control means 129 urges the operator to set correct sheets by displaying the previously stated message on the LCD 120. In the illustrative embodiment, the desired number of prints is assumed to be N.

When the print start key 105 is pressed, the camshaft 44 is moved to the position where the cam plate 43B is capable of contacting the cam follower 41 as during the master sticking operation and trial printing operation. Subsequently, the print drum 12 is driven at the desired printing speed while the path selector 10 is switched to the second position as during the master sticking operation and trial printing operation. After the start of rotation of the print drum 12, one sheet P1 is fed from the sheet feeding section 4 to the registration roller pair 71. The sheet P1 is then conveyed by the registration roller pair 71 at the same timing as during the trial printing operation and pressed against the first image 65A of the master 65 by the press roller 13. The sheet P1 carrying an image corresponding to the first image 65A is steered by the path selector 10 held in the second position toward the auxiliary tray 8. Subsequently, the belt 38 conveys the sheet P1 with the suction fan 39 sucking the sheet P1, so that the sheet P1 is stopped by the end portion 24*a*.

Subsequently, the press roller locking means is operated to lock the press roller 13 in the released position while the stepped cam 49 is rotated to shift the cam shaft 44 to the position where the cam plate 43A is capable of contacting the cam follower 41. The press roller locking means then stops operating. At substantially the same time, the second sheet P2 is fed from the sheet feeding section 4, stopped by the registration roller pair 71, and then conveyed toward the printing section 2 at the same timing as the first sheet P1. The path selector 10 is switched to the first position before the clamper 19 again faces the path selector 10 and again switched to the second position after the passage of the damper 19.

The sheet P2 is then pressed against the first image 65A of the master 65 by the press roller 13, so that a corresponding image is formed on the front side of the sheet P2. The sheet P2 with such an image is steered by the path selector 10 held in the second position toward the auxiliary tray 8. At this instant, the solenoid 33 is operated at the same timing as during the trial printing operation and causes the sheet P1 staying on the auxiliary tray 8 to be conveyed toward the printing section 2 by the press roller 13. After the trailing edge of the sheet P2 has moved away from the nip between the press roller 13 and the print drum 12, the sheet P1 is conveyed to the above nip at the time when the reverse zone of the print drum 12, which follows the intermediate zone, faces the press roller 13. The sheet P1 is then pressed against the second image 65B of the master 65 by the press roller 13, so that a corresponding image is formed on the reverse side of the sheet P1.

During the above operation, just before the intermediate zone of the print drum 12 faces the press roller 13, the solenoid 123 is energized to switch the path selector 10 from the second position to the first position. Consequently, the trailing edge of the sheet P2 being guided by the path selector 10 is brought to the auxiliary tray 8 via a small gap between the bottom 10*a* of the path selector 10 and the press roller 13. The trailing edge of the sheet P1 following the sheet P2 is guided toward the sheet conveying member 85 along the top 10*b* of the path selector 10. The sheet P1 is peeled off from the master 65 by the peeler 84 and then conveyed to the print tray 86 by the sheet conveying member 85.

Subsequently, the third sheet P3 is fed from the sheet feeding section 4, stopped by the registration roller pair 71, and then conveyed toward the printing section 2 at the same timing as the sheet P1. The path selector 10 is located at the first position in order to avoid the clamper 19 and then located at the second position. After an image corresponding to the first image 65A has been printed on the front side of the sheet P3, the sheet P3 is steered by the path selector 10 toward the auxiliary tray 8. Subsequently, the solenoid 33 is energized at the preselected timing to convey the sheet P2 staying on the auxiliary tray 8 toward the printing section 2. The sheet P2 reaches the nip between the print drum 12 and the press roller 13 at the same timing as the sheet P1, so that an image corresponding to the second image 65B is printed on the reverse side of the sheet P1. The path selector 10 is switched from the second position to the first position at the previously stated timing to thereby guide the trailing edge of the sheet P3 toward the auxiliary tray 8 via the small gap between the bottom 10*a* of the path selector 10 and the press roller 13. Thereafter, the leading edge of the sheet P2 conveyed from the auxiliary tray 8 is guided toward the sheet conveying member 85 along the top 10*b* of the path selector 10. The sheet P2 is then peeled off from the master 65 by the peeler 84 and conveyed to the print tray 86 by the sheet conveying member 85.

The procedure described above is repeated up to the "N−1" print. The "N" sheet PN is fed from the sheet feeding section 4, formed with an image corresponding to the first image 65A on its front side, and then guided to the auxiliary tray 8. Subsequently, the "N−1" sheet P (N−1) is formed with an image corresponding to the second image 65B on its reverse side and then driven out to the print tray 86. Thereafter, the press roller locking means is operated to lock the press roller 13 at the released position while the camshaft 44 is shifted to the position where the cam plate 43C is capable of contacting the cam follower 41. At this time, the press roller locking means stops operating with the path selector 10 remaining in the first position.

At a first timing earlier than the time when the leading edge of the second image 65B in the direction of drum rotation arrives at the press roller 13, the cam plate 43C has its projection released from the cam follower 41. As a result, the press roller 13 is pressed against the print drum 12 under the action of the print pressure spring 42. Subsequently, at a second timing slightly earlier than the time when the leading edge of the second image 65B arrives at the press roller 13, the solenoid 33 is energized to move the arm 32 clockwise, as viewed in FIG. 2, about the shaft 32*a*. Consequently, the refeed registration roller 23 is shifted from the released position to the contact position, so that the sheet PN abutting against the end portion 24*a* is pressed against the press roller 13 rotating in contact with the print drum 12.

The sheet PN is conveyed to the nip between the print drum 12 and the press roller 13 at the same timing as the sheet P1, so that an image corresponding to the second image 65B is printed on the reverse side of the sheet PN. The sheet PN is then guided by the top 10*b* of the path selector 10 to the sheet conveying member 85, peeled off by the peeler 84, and conveyed to the print tray 86 by the sheet conveying member 85. Subsequently, when the projection of the cam plate 43C contacts the cam follower 41, the press roller 13 contacted the entire reverse zone of the print drum 12 is released from the print drum 12. This prevents the front zone of the print drum 12 and press roller 13 from contacting each other without the intermediary of the sheet P and thereby obviates the transfer of ink to the press roller 13. At this instant, the press roller locking means is operated to lock the press roller at the released position, and then the print drum 12 is brought to a stop at the home position. The printer 1 thus completed the printing operation again waits in the stand-by position.

Again, the blank portion S between the first and second images 65A and 65B of the master 65 forms the intermediate zone on the print drum 12 when the master 65 is wrapped around the print drum 12. This prevents the trailing edge of the sheet P fed from the sheet feeding section 4 and the leading edge of the sheet P refed from the refeeding means 9 from overlapping each other. Also, the path selector 10 surely guides the sheet P fed from the sheet feeding section 4 and the sheet P refed from the refeeding means 9 to the auxiliary tray 8 and print tray 86, respectively. Further, the image surface of the sheet P refed from the refeeding means 9 contacts the press roller 13, causing the ink to be again transferred from the sheet P1 to the press roller 13. However, because the surface of the press roller 13 is ink-repellent and because the cleaning roller 26 cleans it, the transfer of ink from the sheet P to the press roller 13 is reduced while the removal of the ink from the press roller 13 is promoted. Therefore, the retransfer of the ink from the press roller 13 to the reverse side of the sheet P is obviated during successive printing.

As stated above, in the simplex print mode, the master 66 made by the master making section 3 is wrapped around the print drum 12 while the sheet P fed from the sheet feeding section 4 is pressed against the print drum 12 by the press roller 13. The simplex print mode can therefore be effected in the same manner as in a conventional stencil printer without wasting the stencil 64. In the duplex print mode, the master 65 formed with the first and second images 65A and 65B is wrapped around the print drum 12 while the front side of the first sheet P1 fed from the sheet feeding section 4 is pressed against the print drum 12 by the press roller 13, and then the sheet P1 is brought to the auxiliary tray 8. Subsequently, the second sheet P2 is fed from the sheet feeding section 4, has its front side pressed against the print drum 12 by the press roller 13, and is then brought to the auxiliary tray 8. At the same time, the first sheet P1 is reversed and refed by the refeeding means 9, has its reverse side pressed against the print drum 12 by the press roller 13, and then driven out to the print tray 86. Therefore, images are formed on both sides of the sheet P by the ink transferred from the print drum 12 by the press roller 13, insuring an attractive duplex print. The printing section 2 includes the print drum 12 and press roller 13 smaller in diameter than the print drum 12. This coupled with the fact that the auxiliary tray 8 is positioned below the sheet conveying member 85, prevents the printer 1 from becoming more bulky than the conventional stencil printer operable in the simplex print mode, thereby saving space to be occupied by the printer 1.

In the duplex print mode, the illustrative embodiment forms the first and second images 65A and 65B corresponding to two documents in the stencil 64 and then produces a single kind of duplex prints with the resulting master 65. Alternatively, an ADF may, of course, be mounted on the image scanning section 7 and loaded with three or more documents so as to sequentially produce a plurality of different kinds of duplex prints in cooperation with a sorter connected to the printer 1. In such a case, if the number of documents stacked on the ADF is odd, then the image of the last document is not formed in the stencil 64. If the last page is dealt with in the simplex print mode, then the resulting print is driven out to the sorter face up, i.e., with the image surface facing upward, so that a blank page appears between the last page and the second page from the last. To solve this problem, the master 65 may be formed with the first image 65A corresponding to the last document and simply blank second image 65B and then processed in the previously stated manner. This allows a plurality of kinds of duplex prints to be output in order of page with all of the documents.

In the duplex print mode, the illustrative embodiment causes the image scanning section 7 to read two documents one by one and causes the master making section to produce the master 65 formed with the first and second images 65A and 65B corresponding to the first and second documents in this order. Alternatively, use may be made of comparing means for comparing the amounts of perforations derived from the two documents and determined by the image data stored in the image memory 135. An amount of perforations may be interpreted as the operation ratio of the heat-generating elements of the thermal head 59, i.e., whether or not solid portions are present and the number of solid portions. In this case, an image with a small amount of perforations and an image with a large amount of perforations may be formed in the master 65 as the first and second images 65A and 65B, respectively. With this configuration, it is possible to make the amount of ink to be transferred from the print drum 12 to the front side of the sheet P than the amount of ink to be transferred to the reverse side of the same. Therefore, when the refeeding means 9 refeeds the sheet P carrying the image on its front side from the auxiliary tray 8, a minimum amount of ink is retransferred from the sheet P to the press roller 13. This not only insures attractive prints, but also reduces the load on the cleaning member for thereby extending its life.

In the illustrative embodiment, the cleaning roller 26 assigned to the press roller 13 is constantly pressed against the press roller 13. If desired, the cleaning roller 26, like the refeed registration roller 23, may be selectively moved into or out of contact with the press roller 13. More specifically, in the simplex print mode in which ink is not retransferred from the sheet P to the press roller 13, the cleaning roller 26 may be released from the press roller 13 so as to suffer from a minimum of deterioration.

In the master sticking or the trial printing operation effected in the duplex print mode in the illustrative embodiment, after the cam shaft 44 has been moved to bring the cam plate 43B to the position where it is capable of contacting the cam follower 41, the first sheet P1 is fed from the sheet feeding section 4. Subsequently, after an image corresponding to the first image 65A has been printed on the front side of the sheet P1, the sheet P1 is guided to the auxiliary tray 8. The cam shaft 44 is then shifted to the position where the cam plate 43A is capable of contacting the cam follower 41, and then the second sheet P2 is fed from the sheet feeding section 4, formed with an image corresponding to the second image 65B on its reverse side, and then driven out to the print tray 86. An alternative procedure available with the present invention is as follows. After one sheet P formed with an image corresponding to the first image 65A has been guided to the auxiliary tray 8, the cam shaft 44 is shifted to the position where the cam plate 43C is capable of contacting the cam follower 41, thereby pressing the press roller 13 against the print drum. Subsequently, slightly before the leading edge of the second image of the master 65 arrives at the press roller 13, the solenoid 33 is energized to feed the sheet P from the auxiliary tray 8 so as to print an image corresponding to the second image 65B on the reverse side. Thereafter, the sheet P is driven out to the print tray 86. Such an alternative procedure suffices a single sheet P for both of the master sticking operation and trial printing operation and therefore saves cost.

Second Embodiment

A second embodiment will be described hereinafter with reference to FIG. 9. As shown, the second embodiment is identical with the first embodiment except that the press roller 13 is replaced with a press roller 136, the cleaning roller 26 is replaced with a cleaning roller 137, the multiple-step cam 43 is replaced with a multiple-step cam 138, and press roller drive means 139 is additionally included.

The press roller 136, like the press roller 13, has at least its surface formed of an ink-repellent material and has its core 136*a* rotatably supported by the arms 20 at opposite ends. The rear end of the core 136*a* protrudes from the associated arm 20. A timing pulley 140 and a cleaning roller drive gear 141 are mounted on the protruding end of the core 136 in this order, as named from the front end toward the rear end.

A timing pulley 142 and press roller drive gear 143 are mounted on the rear end portion of the shaft 21 protruding from the rear arm 20 in this order, as named from the front end toward the rear end. A timing belt 144 is passed over the timing pulleys 140 and 142, which are identical in configuration. A press roller drive motor 145 is mounted on the housing 11 in the vicinity of the press roller drive gear 143. A pinion 146 is mounted on the output shaft 145*a* of the motor 145 and held in mesh with the press roller drive gear 143. The motor 145 is controlled by the control means 129.

The timing pulleys 140 and 142, press roller drive gear 143, timing belt 144, press roller drive motor 145 and pinion 146 constitute the press roller drive means 139. The press roller drive means 139 causes the press roller 136 to rotate at the same peripheral speed as the print drum 12. The timing pulleys 140 and 142 and timing belt 144 constitute drive transmitting means 150.

The cleaning roller 137 similar to the cleaning roller 26 has a core 137*a* rotatably supported by the arms 20 at the same position and in the same manner as the core 26*a* of the cleaning roller 26. The rear end of the core 137*a* protrudes from the associated arm 20. A driven gear 147 is mounted on the so protruding end of the core 137*a*. A shaft 148 is studded on the outer surface of the rear arm 20 between the cores 136*a* and 137*a*. A reduction idle gear 149 is rotatably supported by the shaft 148 via a bearing, not shown, and includes a larger diameter gear 149*a* and a smaller diameter gear 149*b* meshing with the cleaning roller drive gear 141 and driven gear 147, respectively. The gear ratio between the cleaning roller drive gear 141, driven gear 147, larger diameter gear 149*a* and smaller diameter gear 149*b* is selected such that the peripheral speed of the cleaning roller 137 is about one-tenth of the peripheral speed of the press roller 136.

The multiple-stage cam 138 has three cam plates 138A, 138B and 138C and mounted on the shaft 44 in the same order and in the same manner as the cam plates 34A through 34C. The cam plates 138A through 138C, like the cam plates 43A through 43C, each have a base portion and a projection. The projection of the cam plate 138A is configured to cause the press roller 13 to contact the drum 12 over a range including the front zone, intermediate zone and reverse zone. The projection of the cam plate 138B is configured to cause the press roller 13 to contact the drum 12 over the front zone. Further, the projection of the cam plate 138C is configured to caused the press roller 13 to contact the drum 12 over the reverse zone.

The operation of the illustrative embodiment will be described hereinafter. As for the image scanning, master discharging, master making, master feeding, master sticking, trial printing and printing operations, the illustrative embodiment is identical with the previous embodiment except that the press roller 136 is driven to rotate. The following description will concentrate on the duplex print mode operation unique to the illustrative embodiment.

When the operator selects the duplex print mode, inputs the thickness of sheets to use and then presses the perforation start key 104, the image scanning section 7, master discharging section 5 and master making section 3 are caused to operate in parallel. The master 65 with the first and second images 65A and 65B produced by the master making operation is wrapped around the print drum 12.

To stick the master 65 to the print drum 12, when the print drum 12 with the master 65 is stopped at its home position, the press roller locking means is operated while the stepping motor 52 is driven to rotate the stepped cam 49 such that the cam portion 49*a* contacts the cam follower 48*c*. As a result, the cam shaft 44 is shifted to the position where the cam plate 138B is capable of contacting the cam follower 41. Subsequently, the press roller locking means stops operating. Thereafter, one sheet P is fed from the sheet tray 67 to the registration roller pair 71.

After the clamper 19 has moved away from the position corresponding to the path selector 10, the path selector 10 is moved to the second position. Thereafter, the drive roller 71*a* is driven at a preselected timing at which the leading edge of the first image 65A in the direction of rotation of the print drum 12 reaches the press roller 136, thereby conveying the sheet P toward the position between the print drum 12 and the press roller 136. At the same time, the press roller drive motor 145 is driven to rotate the press roller 136 counterclockwise, as viewed in FIG. 9, about its core 136*a*.

At the above timing, the cam plate 43B causes its projection to move away from the cam follower 41 with the result that the press roller 136 is pressed against the print drum 12 under the action of the print pressure spring 42. Consequently, an image corresponding to the first image 65A is printed on the front side of the sheet P, so that the part of the master 65 formed with the first image 65A is stuck to the print drum 12.

The sheet P with the above image is steered by the path selector 10 held in the second position to the refeeding means 9 as in the previous embodiment. The sheet P reached the auxiliary tray 8 is conveyed by the belt 38 in a direction indicated by an arrow in FIG. 9 and then stopped with its leading edge abutting against the end portion 24*a*.

The press roller 136, contacted the entire front zone of the print drum 12, is moved to the released position because the cam plate 138 contacts the cam follower 41. At this instant, the press roller locking means and press roller drive motor 145 both are caused to stop operating, so that the press roller 136 remains in a halt at the released position. Subsequently, the stepping motor 52 is driven to rotate the stepped cam 49 to the position where the cam portion 49*c* contacts the cam follower 48*c*. Consequently, the cam shaft 44 is shifted to the position where the cam plate 138C is capable of contacting the cam follower 41.

In the press roller moving mechanism 55, when the camshaft 44 is rotated to the position where the projection of the cam plate 138C is capable of contacting the cam follower 41, the press roller locking means is caused to stop operating. The path selector 10 is switched from the second position to the first position before the damper 19 again faces the path selector 10. At a preselected timing slightly earlier than the time when the leading edge of the second image 65B of the master 65 faces the press roller 136, the press roller drive motor 145 and solenoid 33 are energized. The refeed registration roller 145 is therefore moved from the released position to the contact position, so that the sheet P whose leading edge is stopped by the end portion 24*a* is brought into contact with the press roller 136. At this instant, the press roller 136 is rotating in contact with and at the same peripheral speed as the print drum 12.

The sheet P so pressed against the press roller 136 by the refeed registration roller 23 is conveyed toward the print drum 12 while being pressed against the press roller 136 by the refeed guide member 22. At the timing when the leading edge of the reverse zone of the print drum 12 faces the press roller 136, the sheet P is conveyed to the nip between the print drum 12 and the press roller 136. As a result, an image corresponding to the second image 65B is printed on the reverse side of the sheet P, so that the other part of the master 65 formed with the second image 65B is stuck to the print drum 12. The sheet P carrying the images on both sides thereof is steered by the path selector 10 held in the first position to the sheet conveying member 85 and driven out tot he print tray 86 thereby.

Subsequently, when the projection of the cam plate 138C contacts the cam follower 41, the press roller locking means and press roller drive motor 145 are caused to stop operating, thereby holding the press roller 136 stationary at the released position. Thereafter, the print drum 12 is rotated to its home position and stopped there. This is the end of the master sticking operation.

During the master sticking operation stated above, the image surface of the sheet P refed from the refeeding means 9 contacts the press roller 136, causing the ink to be again transferred from the sheet P to the press roller 136. However, because the surface of the press roller 136 is ink-repellent and because the cleaning roller 137 rotating in synchronism with the press roller 136 cleans it, the transfer of ink from the sheet P to the press roller 136 is reduced while the removal of the ink from the press roller 136 is promoted. Therefore, the retransfer of the ink from the press roller 136 to the reverse side of the sheet P is obviated during successive printing.

Assume that after the master sticking operation the operator inputs desired printing conditions on the print speed key 113 and various keys on the operation panel 103 and then presses the trial print key 106. Then, the cam shaft 44 is shifted to the position where the cam plate 138B is capable of contacting the cam follower 41, and then the press roller locking means is deenergized. As a result, the print drum 12 is caused to rotate at the desired print speed while the path selector 10 is held at the second position. One sheet P is fed from the sheet feeding section 4 while the press roller 136 is driven to rotate. The sheet P is conveyed toward the printing section 2 at the same timing as during the master sticking operation, so that an image corresponding to the first image 65A of the master 65 is formed on the front side of the sheet P. The sheet P with the image is steered by the path selector 10 toward the auxiliary tray 8 and then stopped with its leading edge abutting against the end portion 24*a*.

Subsequently, the press roller locking means is operated to lock the press roller 136 in the released position while the press roller drive motor 145 is deenergized. After the cam shaft 44 has been shifted to the position where the cam plate 138C is capable of contacting the cam follower 41, the press roller locking means is caused to stop operating. The path selector 10 is switched from the second position to the first position before the damper 19 again faces the path selector 10.

The press roller drive motor 145 and solenoid 33 are energized at the same timing as during the master sticking operation, moving the refeed registration roller 23 from the released position to the contact position to thereby pressing the sheet P against the press roller 136. The sheet P is conveyed by the press roller 136 toward the printing section 2 while being pressed against the press roller 136 by the refeed guide member 22. The press roller 136 presses the sheet P against the second image 65B of the master 65. Subsequently, the sheet P carrying the images on both sides thereof is steered by the path selector 10 to the sheet conveying member 85 and driven out to the print tray 86 thereby.

When the projection of the cam plate 138C is brought into contact with the cam follower 41, the press roller locking means is operated while the press roller drive motor 145 is deenergized, holding the press roller 136 stationary at the released position. Thereafter, the print drum 12 is rotated to its home position and stopped there. This is the end of the trial printing operation.

When the operator, confirmed the position, density and so forth of the images formed by trial printing, inputs a desired number of prints on the numeral keys 109 and then presses the print start key 105, the illustrative operation executes the printing operation like the previous embodiment. In the illustrative embodiment, the desired number of prints is assumed to be N.

When the print start key 105 is pressed, the camshaft 44 is moved to the position where the cam plate 138B is capable of contacting the cam follower 41 as during the master sticking operation and trial printing operation, and then the press roller locking means is caused to stop operating. The print drum 12 is driven at an input print speed while the path selector 10 is switched to the second position. After the start of rotation of the print drum 12, one sheet P1 is fed from the sheet feeding section 4 while the press roller 136 is driven to rotate. As a result, an image corresponding to the first image 65A of the master 65 is printed on the front side of the sheet P1 in the printing section 2. The sheet P1 carrying the image is steered by the path selector 10 toward the auxiliary tray 8 and then stopped with its leading edge abutting against the end portion 24*a*.

Subsequently, the press roller locking means is operated to lock the press roller 136 in the released position while press roller drive motor 145 is deenergized. The cam shaft 44 is shifted to the position where the cam plate 138A is capable of contacting the cam follower 41. Subsequently, the press roller drive motor 145 is energized while the press roller locking means is caused to stop operating. At substantially the same time as this operation, the second sheet P2 is fed from the sheet feeding section 4, stopped by the registration roller pair 71, and then conveyed toward the printing section 2 at the same timing as the first sheet P1. The path selector 10 is switched to the first position before the damper 19 again faces the path selector 10 and again switched to the second position after the passage of the damper 19.

The sheet P2 is then pressed against the first image 65A of the master 65 by the press roller 136, so that a corresponding image is printed on the front side of the sheet P2. The sheet P2 with such an image is steered by the path selector 10 held in the second position toward the auxiliary tray 8. At this instant, the solenoid 33 is operated at the same timing as during the trial printing operation and causes the sheet P1 staying on the auxiliary tray 8 to be conveyed toward the printing section 2 by the press roller 136. After the trailing edge of the sheet P2 has moved away from the nip between the press roller 136 and the print drum 12, the sheet P1 is conveyed to the above nip at the time when the reverse zone of the print drum 12 faces the press roller 136. The sheet P1 is then pressed against the second image 65B of the master 65 by the press roller 136, so that a corresponding image is printed on the reverse side of the sheet P1.

During the above operation, just before the intermediate zone of the print drum 12 faces the press roller 136, the solenoid 123 is energized to switch the path selector 10 from the second position to the first position. Consequently, the trailing edge of the sheet P2 being guided by the path selector 10 is brought to the auxiliary tray 8 via a small gap between the bottom 10*a* of the path selector 10 and the press roller 136. The trailing edge of the sheet P1 following the sheet P2 is guided toward the sheet conveying member 85 along the top 10*b* of the path selector 10. The sheet P1 is peeled off from the master 65 by the peeler 84 and then conveyed to the print tray 86 by the sheet conveying member 85.

Subsequently, the third sheet P3 is fed from the sheet feeding section 4, stopped by the registration roller pair 71, and then conveyed toward the printing section 2 at the same timing as the sheet P1. The path selector 10 is located at the first position in order to avoid the clamper 19 and then located at the second position. After an image corresponding to the first image 65A has been printed on the front side of the sheet P3, the sheet P3 is steered by the path selector 10 toward the auxiliary tray 8. Subsequently, the solenoid 33 is energized at the preselected timing to convey the sheet P2 staying on the auxiliary tray 8 toward the printing section 2. The sheet P2 reaches the nip between the print drum 12 and the press roller 136 at the same timing as the sheet P1, so that an image corresponding to the second image 65B is printed on the reverse side of the sheet P2. The path selector 10 is switched from the second position to the first position at the previously stated timing to thereby guide the trailing edge of the sheet P3 toward the auxiliary tray 8 via the small gap between the bottom 10*a* of the path selector 10 and the press roller 136. Thereafter, the leading edge of the sheet P2 conveyed from the auxiliary tray 8 is guided toward the sheet conveying member 85 along the top 10*b* of the path selector 10. The sheet P2 is then peeled off from the master 65 by the peeler 84 and conveyed to the print tray 86 by the sheet conveying member 85.

The procedure described above is repeated up to the "N−1" print. The "N" sheet PN is fed from the sheet feeding section 4, formed with an image corresponding to the first image 65A on its front side, and then guided to the auxiliary tray 8. Subsequently, the "N−1" sheet P(N−1) is formed with an image corresponding to the second image 65B on its reverse side and then driven out to the print tray 86. Thereafter, the press roller locking means is operated to lock the press roller 136 at the released position while the press roller drive motor 145 is deenergized. The cam shaft 44 is therefore shifted to the position where the cam plate 138C is capable of contacting the cam follower 41. Subsequently, the press roller drive motor 145 is again energized while the press roller locking means is caused to stop operating; the path selector 10 is held in the first position.

Figure 9:
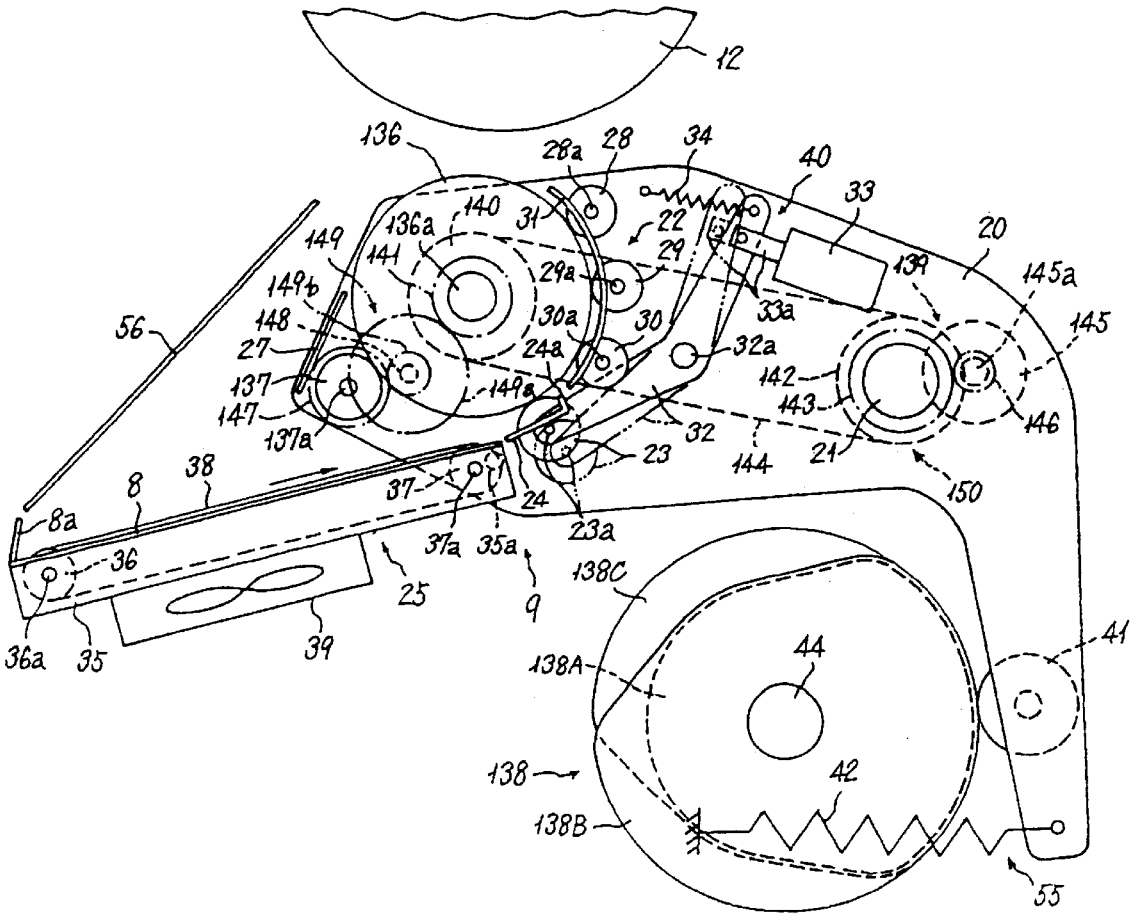
FIG. 9 is a front view showing a second embodiment of the present invention.

At a timing slightly earlier than the time when the leading edge of the second image 65B in the direction of drum rotation arrives at the press roller 136, the solenoid 33 is energized to move the arm 32 clockwise, as viewed in FIG. 9, about the shaft 32*a*. As a result, the refeed registration roller 23 is moved from the released position to the contact position and presses the sheet PN held stationary with its leading edge abutting against the end portion 24*a* against the press roller 136, which is being driven by the press roller drive motor 145. Thereafter, at a timing when the time when the leading edge of the second image 65B arrives at the press roller 136, the cam projection of the cam plate 138C is released from the cam follower 41, causing the press roller 136 to contact the print drum 12 under the action of the print pressure spring 42. Consequently, an image corresponding to the second image 65B is printed on the reverse side of the sheet PN The sheet PN carrying the images on both sides thereof is guided by the top 10*b* of the path selector 10 to the sheet conveying member 85, peeled off by the peeler 84, and conveyed to the print tray 86 by the sheet conveying member 85. Subsequently, the press roller 136, contacted the entire reverse zone of the print drum 12, is released from the print drum 12 because the projection of the cam plate 138C contacts the cam follower 41. At this instant, the press roller locking means is operated while the press roller drive motor 145 is deenergized, locking the press roller 136 at the released position. Subsequently, the print drum 12 is brought to a stop at the home position. The printer 1 thus completed the printing operation again waits in the stand-by position.

As stated above, in the illustrative embodiment, the press roller drive motor 145 causes the press roller 136 to rotate at the same peripheral speed as the print drum 12. Therefore, when the sheet P is refed from the auxiliary tray 8 by the refeeding means 9, the peripheral speed of the press roller 136 is prevented from varying due to the contact of the press roller 136 with the refeed registration roller 23 and rollers 28 through 30. The print drum 12 and press roller 136 are therefore free from a difference in peripheral speed and insure attractive prints.

Further, when the press roller 136 is angularly moved, the drive transmitting means 150 obviates a change in phase ascribable to the rotation of the press roller 136 and thereby prevents the surface of the press roller 136 from being shifted when brought into contact with the print drum 12. This also insures attractive images free from blurring and image dislocation. While the illustrative embodiment uses two timing pulleys 140 and 142 and timing belt 144 as the drive transmitting means 150, use may alternatively be made of drive transmitting means including gears freely rotatably mounted on the shaft 21 and core 136*a* and an odd number of idle gears intervening between the gears.

In a modification of the illustrative embodiment, the press roller 136 is provided with a one-way clutch and caused to follow the rotation of the print drum 12 via the one-way clutch when pressed against the print drum 12. In this configuration, when a difference occurs between the peripheral speed of the print drum 12 and that of the press roller 136, a load that would cause the press roller drive motor 145 to fail does not act on the motor 145. In addition, no loads act on the master 65 or 66 wrapped around the print drum 12, so that the master 65 or 66 is free from damages including deformation and tearing.

Figure 10:
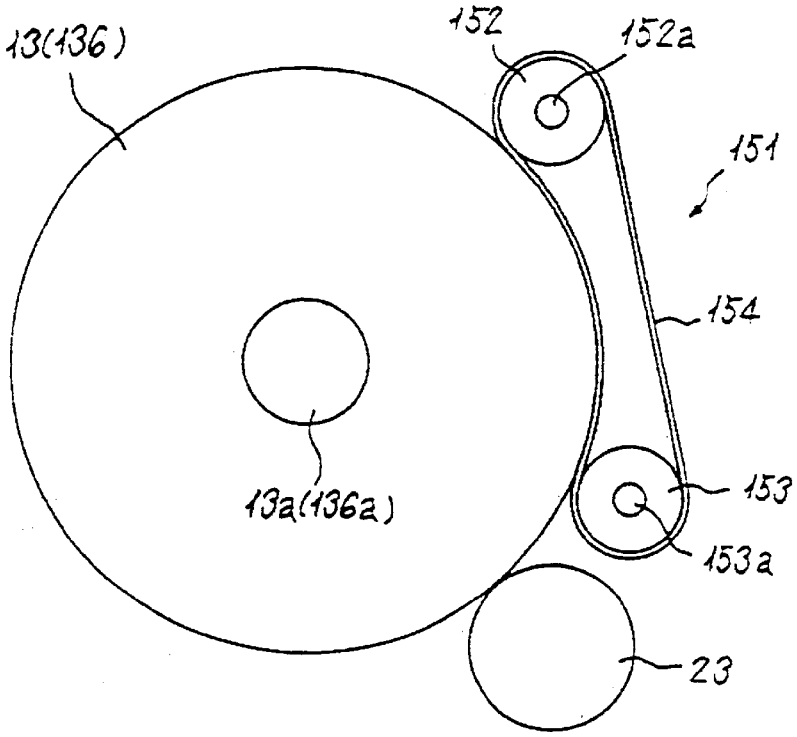
FIG. 10 shows a modified form of a refeed guide member applicable to the first and second embodiments.

FIG. 10 shows another specific configuration of the refeed guide member applicable to the first and second embodiments described above. As shown, the refeed guide member, labeled 151, includes two rollers 152 and 153 mounted on shafts 152*a* and 153*a*, respectively, and a belt 154 passed over the rollers 152 and 153. The shafts 152*a* and 153*a* each are rotatably supported by the arms 20 and constantly biased toward the core 13*a* or 136*a* by biasing means not shown. The rollers 152 and 153 each extend over substantially the entire width of the press roller 13 or 136. In this configuration, the belt 154 is pressed against the press roller 13 or 136 between the rollers 152 and 153.

In each of the illustrative embodiments shown and described, the rollers 28 through 30 constituting the refeed guide member 22 and the press roller 13 or 136 contact each other on lines. By contrast, in the refeed guide member 151, the belt 154 contacts the press roller 13 or 136 over a substantial area and promotes the close contact of the sheet P with the press roller 13 or 136. This further reduces dislocation between the press roller 13 or 136 and the sheet P.

Figure 11:
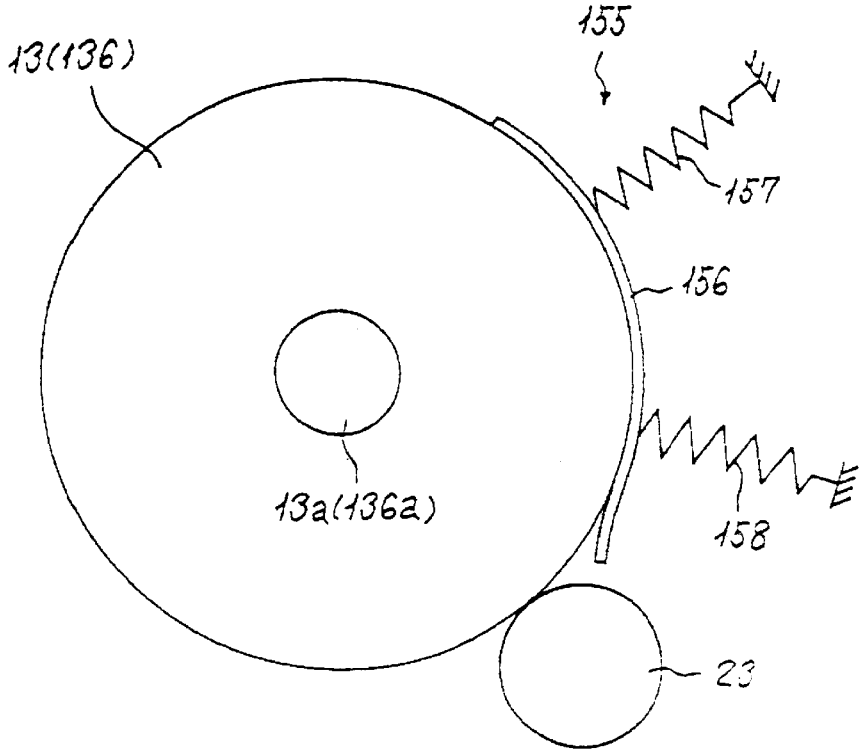
FIG. 11 shows another modified form of the refeed guide member.

FIG. 11 shows still another specific configuration of the refeed guide member applicable to the first and second embodiments. As shown, the refeed guide member, labeled 155, includes a curved guide plate 156 and two compression springs 157 and 158. The guide plate 156, which is substantially identical in width with the press roller 13 or 136, is provided with the same curvature as the press roller 13 or 136. One end of the guide plate 156 adjoining the refeed registration roller 23 is implemented as an inlet portion 156*a* for allowing the sheet P to smoothly enter the nip between the guide plate 156 and the press roller 13 or 136. The compression springs 157 and 158 each are anchored at one end to a bracket, not shown, mounted on one arm 20 and at the other end to the surface of the guide plate 156 opposite to the surface held in contact with the press roller 13 or 136. The refeed guide member 155 achieves the same advantages as the refeed guide member 151.

Third Embodiment

Figure 12:
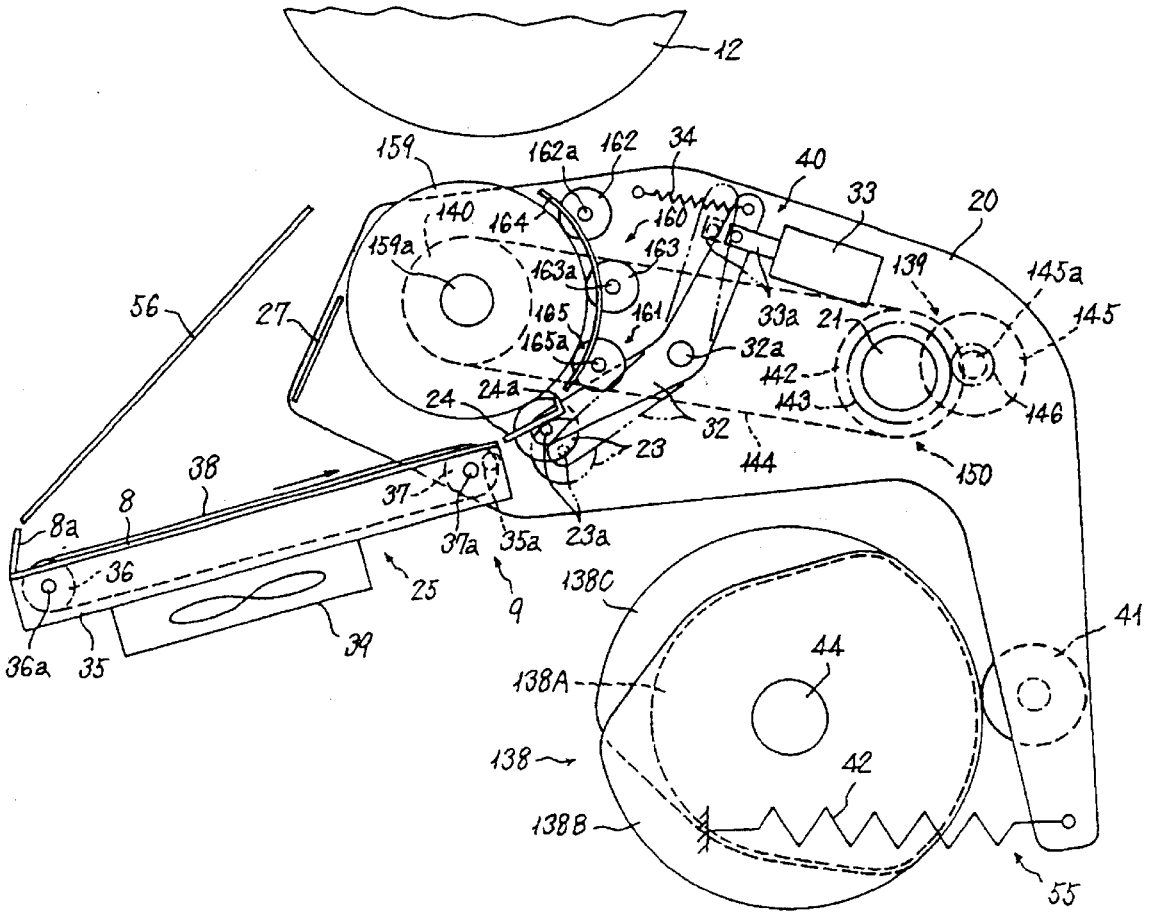
FIG. 12 is a front view showing a third embodiment of the present invention.

Reference will be made to FIG. 12 for describing a third embodiment of the present invention. As shown, the third embodiment is identical with the second embodiment except that a press roller 159 is substituted for the press roller 136, that a refeed guide member 160 is substituted for the refeed guide member 22, and that a cleaning member 161 is substituted for the cleaning roller 137.

The press roller 159 is made up of a metallic core 159*a* and an elastic layer wrapped around the core 159 and formed of, e.g., rubber. The press roller 159 extends in the axial direction of the print drum 12. The core 159*a* is rotatably supported by the arms 20. The press roller 159 is also driven by the press roller drive motor 145. The circumferential length of the press roller 159 is greater than the circumferential length of the front zone or that of the reverse zone of the print drum 12. At least the surface of the press roller 159 is formed of tetrafluoroethylene resin or similar ink-repellent material.

The refeed guide member 160, positioned at the right-hand side of the press roller 159, includes a plurality of rollers 162 and 163 each being implemented as segment rollers and a sheet guide plate 164. The rollers 162 and 163 are mounted on shafts 162*a* and 163*a*, respectively, and pressed against the press roller 159. The sheet guide plate 164 is so curved as to guide the sheet P along the surface of the press roller 159. The shafts 162*a* and 163*a* each are rotatably supported by the arms 20 at opposite ends and constantly biased toward the core 159*a* by biasing means not shown. The segment rollers 162 and 163 are mounted on the shafts 162*a* and 163*a*, respectively, at spaced locations in the axial direction of the press roller 159. The sheet guide plate 164 is spaced from the press roller 159 by a distance slightly smaller than the radius of each roller 162 or 163 and affixed to the arms 20 at opposite ends. The sheet guide plate 164 is provided with a curvature whose center coincides with the axis of the core 159*a* and is formed with a plurality of openings for allowing the rollers 162 and 163 and cleaning roller 165 to contact the press roller 159.

Figure 13:
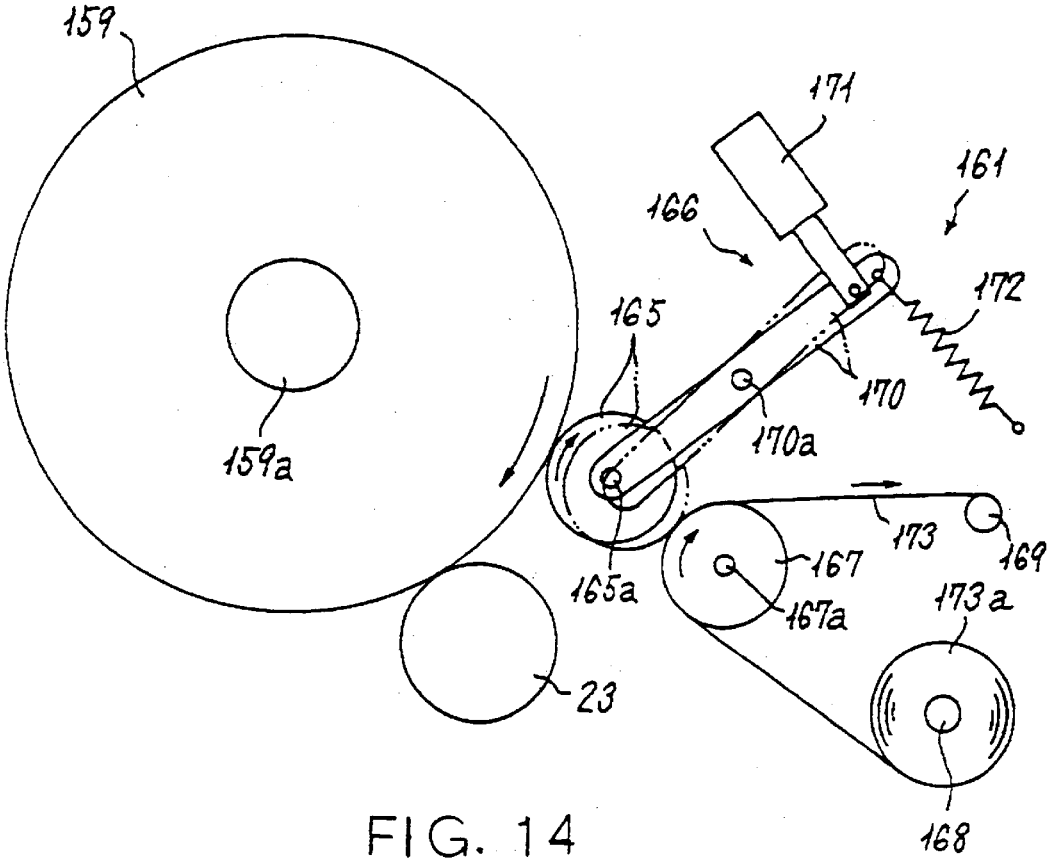
FIG. 13 shows a cleaning member included in the third embodiment.

As shown in FIG. 13, the cleaning member 161 includes a cleaning roller 165, cleaning roller moving means 166, a wiping roller 167, a roll holding member 168, and a sheet take-up member 169. The cleaning roller 165 extends in the axial direction of the print drum 12 over the same width of the press roller 159. As shown in FIG. 12, the cleaning roller 165 is interposed between the refeed guide member 160 and the refeed registration roller 23. At least the surface of the cleaning roller 165 is formed of rubber or similar material to which the ink easily deposits when the roller 165 is brought into contact with the press roller 159.

The cleaning roller moving means 166 adjoins the cleaning roller 165 and includes a pair of arms 170 (only one is visible), a pair of solenoids 171, and a pair of tension springs 172. A shaft 170*a* is positioned between and journalled to the arms 20. The arms 170 each are mounted on one end portion of the shaft 170 adjacent the adjoining arm 20 at substantially the center thereof. The shaft 165*a* of the cleaning roller 165 is journalled to one end portions of the arms 170. The solenoids 171 each are mounted on one of the arms 20 and include a plunger 171*a* connected to the other end of one arm 170. The tension springs 172 each are anchored at one end to one of the arm 20 and at the other end to one of the arms 170. In this configuration, when the solenoids 171 are energized, the cleaning roller 165 is released from the press roller 159 to a position indicated by a phantom line in FIG. 13. When the solenoids 171 are deenergized, the cleaning roller 165 is again pressed against the press roller 159 under the action of the tension springs 172, as indicated by a solid line in FIG. 13.

A cleaning roller drive motor, not shown, is mounted on the outer surface of one of the arms 170. The output torque of this motor is transferred to the cleaning roller 165 via drive transmitting means including, e.g., gears, causing the roller 165 to rotate in the same direction as the press roller, as indicated by an arrow in FIG. 13. The peripheral speed of the cleaning roller 165 is selected to be about one-tenth of the peripheral speed of the press roller 159.

The wiping roller 167 is positioned below and at the right-hand side of the cleaning roller 165 while the roll holding member 168 and sheet take-up member 169 are located at the right-hand side of the wiping roller 167. The wiping roller 167 has the same width as the cleaning roller 165 and is journalled to the arms 20. At least the surface of the wiping roller 167 is formed of rubber or similar material having high frictional resistance. Biasing means, not shown, constantly biases the shaft 167*a* toward the press roller 159 such that when the cleaning roller 165 is released from the press roller 159, the cleaning roller 165 and wiping roller 167 contact each other under preselected pressure.

The roll holding member 168 is affixed to the arms 20 and rotatably, removably supports a cleaning sheet or webbing 173 implemented as a roll 173*a*. The cleaning sheet 173 wipes off the ink deposited on the cleaning roller 165. One edge of the cleaning sheet 173 paid out from the roll 173*a* is retained by the sheet take-up member 169 by way of the circumference of the wiping roller 167. A take-up motor, not shown, positioned between the arms 20 causes the sheet take-up member 169 to rotate and take up the cleaning sheet 173 in a direction indicated by an arrow in FIG. 13.

The operation of the illustrative embodiment will be described hereinafter. As for the image reading, master discharging, master feeding, master sticking, trial printing and printing operations in the simplex print mode, the illustrative embodiment is identical with the second embodiment except that the cleaning roller 165 is released from the press roller 159 when the solenoids 171 are energized. The following description will concentrate on the duplex print mode operation.

When the operator selects the duplex print mode, inputs the thickness of sheets to use, and then press the perforation start key 104, the image scanning section 7, master discharging section 5 and master making section 3 are caused to operate in parallel. The master 65 with the first and second images 65A and 65B produced by the master making operation is wrapped around the print drum 12. To stick the master 65 to the print drum 12, when the print drum 12 with the master 65 is stopped at its home position, the cam shaft 44 is shifted to the position where the cam plate 138B is capable of contacting the cam follower 41. Subsequently, one sheet P is fed from the sheet feeding section 4 to the registration roller pair 71. When the perforation start key 104 is pressed, the solenoids 71 are energized and hold the cleaning roller 165 in the position released from the press roller 159.

After the clamper 19 has moved away from the position corresponding to the path selector 10, the path selector 10 is moved to the second position. Thereafter, the drive roller 71*a* is driven at a preselected timing at which the leading edge of the first image 65A in the direction of rotation of the print drum 12 reaches the press roller 136, thereby conveying the sheet P toward the position between the print drum 12 and the press roller 136. At the same time, the press roller drive motor 145 is driven to rotate the press roller 159 counterclockwise, as viewed in FIG. 12, about its core 159*a*.

At the above timing, the cam plate 138B causes its projection to move away from the cam follower 41 with the result that the press roller 159 is pressed against the print drum 12 under the action of the print pressure spring 42. Consequently, an image corresponding to the first image 65A is printed on the front side of the sheet P, so that the part of the master 65 formed with the first image 65A is stuck to the print drum 12. The sheet P with the above image is steered by the path selector 10 held in the second position to the refeeding means 9 as in the previous embodiments. The sheet P reached the auxiliary tray 8 is conveyed by the belt 38 in a direction indicated by an arrow in FIG. 12 and then stopped with its leading edge abutting against the end portion 24*a*.

The press roller 159, contacted the entire front zone of the print drum 12, is moved to the released position because the projection of the cam plate 138B contacts the cam follower 41. At this instant, the press roller locking means and press roller drive motor 145 both are caused to stop operating, so that the press roller 159 remains in a halt at the released position. Subsequently, the cam shaft 44 is shifted to the position where the cam plate 138C is capable of contacting the cam follower 41.

In the press roller moving mechanism 55, when the cam shaft 44 is rotated to the position where the projection of the cam plate 138C is capable of contacting the cam follower 41, the press roller locking means is caused to stop operating. The path selector 10 is switched from the second position to the first position before the damper 19 again faces the path selector 10. At a preselected timing slightly earlier than the time when the leading edge of the second image 65B of the master 65 faces the press roller 159, the press roller drive motor 145 and solenoid 33 are energized. The refeed registration roller 145 is therefore moved from the released position to the contact position, so that the sheet P whose leading edge is stopped by the end portion 24*a* is brought into contact with the press roller 159.

The sheet P so pressed against the press roller 159 by the refeed registration roller 23 is conveyed toward the print drum 12 while being pressed against the press roller 159 by the refeed guide member 22. At the timing when the leading edge of the reverse zone of the print drum 12 faces the press roller 159, the sheet P is conveyed to the nip between the print drum 12 and the press roller 159. As a result, an image corresponding to the second image 65B is printed on the reverse side of the sheet P, so that the other part of the master 65 formed with the second image 65B is stuck to the print drum 12. The sheet P carrying the images on both sides thereof is steered by the path selector 10 held in the first position to the sheet conveying member 85 and driven out to the print tray 86 thereby.

Subsequently, when the projection of the cam plate 138C contacts the cam follower 41, the press roller locking means is caused to stop operating, holding the press roller 159 stationary at the released position while in rotation. As soon as the press roller 159 completes one rotation after the turn-on of the solenoid 33, the solenoid 33 and solenoids 71 are turned off. As a result, the refeed roller 23 is moved to the released position while the cleaning roller 165 is moved to the contact position. At this time, the cleaning roller drive motor is energized to rotate the cleaning roller 165. When the press roller 159 completes one rotation, the press roller drive motor 145 is deenergized while the solenoids 171 are energized to move the cleaning roller 165 to the released position. Subsequently, the take-up motor is energized to rotate the sheet take-up member 169 with the result that the cleaning sheet 173 is fed by a preselected amount in a direction indicated by an arrow in FIG. 13 while contacting the cleaning roller 165. During this period of time, the print drum 12 is rotated to the home position and stopped there. After the print drum 12, press roller 159, cleaning roller 165 and sheet take-up member 169 have been stopped, the printer 1 waits in the stand-by state.

During the master sticking operation stated above, the image surface of the sheet P refed from the refeeding means 9 contacts the press roller 159, causing the ink to be again transferred from the sheet P to the press roller 159. However, because the surface of the press roller 159 is ink-repellent and because the cleaning roller 165 moved and rotated at preselected timing cleans the press roller 159, the transfer of ink from the sheet P to the press roller 159 is reduced while the removal of the ink from the press roller 159 is promoted. Therefore, the retransfer of the ink from the press roller 159 to the reverse side of the sheet P is obviated during successive printing. Further, because the cleaning sheet 173 cleans the surface of the cleaning roller 165, the cleaning roller 165 can always clean the press roller 159 in a clean condition.

Assume that after the master sticking operation the operator inputs desired printing conditions on the print speed key 113 and various keys on the operation panel 103 and then presses the trial print key 106. Then, the cam shaft 44 is shifted to the position where the cam plate 138B is capable of contacting the cam follower 41, and then the press roller locking means is deenergized. As a result, the print drum 12 is caused to rotate at the desired print speed while the path selector 10 is held at the second position. One sheet P is fed from the sheet feeding section 4 while the press roller 159 is driven to rotate. The sheet P is conveyed toward the printing section 2 at the same timing as during the master sticking operation, so that an image corresponding to the first image 65A of the master 65 is printed on the front side of the sheet P. The sheet P with the image is steered by the path selector 10 toward the auxiliary tray 8 and then stopped with its leading edge abutting against the end portion 24*a*. During this period of time, the solenoids 171 are continuously energized, holding the cleaning roller 165 at the released position.

Subsequently, the press roller locking means is operated to lock the press roller 159 in the released position while the press roller drive motor 145 is deenergized. After the cam shaft 44 has been shifted to the position where the cam plate 138C is capable of contacting the cam follower 41, the press roller locking means is caused to stop operating. The path selector 10 is switched from the second position to the first position before the clamper 19 again faces the path selector 10.

The press roller drive motor 145 and solenoid 33 are energized at the same timing as during the master sticking operation, moving the refeed registration roller 23 from the released position to the contact position to thereby press the sheet P against the press roller 159. The sheet P is conveyed by the press roller 159 toward the printing section 2 while being pressed against the press roller 159 by the refeed guide member 160. The press roller 159 presses the sheet P against the second image 65B of the master 65. Subsequently, the sheet P carrying the images on both sides thereof is steered by the path selector 10 to the sheet conveying member 85 and driven out to the print tray 86 thereby.

When the projection of the cam plate 138C is brought into contact with the cam follower 41, the press roller locking means is operated to hold the press roller 159 in rotation in the released position. Thereafter, the solenoid 33 and solenoids 171 are deenergized, moving the refeed registration roller 23 and cleaning roller 165 to the released position and contact position, respectively. Subsequently, the cleaning roller drive motor is energized to cause the cleaning roller 165 to rotate. When the press roller 159 completes one rotation after the start of rotation of the cleaning roller 165, the press roller drive motor 145 is deenergized while the solenoids 171 are energized to move the cleaning roller 145 to the released position. At this time, the take-up motor is energized to feed the cleaning sheet 173 by the preselected amount in the previously mentioned direction while contacting the cleaning roller 165 in rotation. During this period of time, the print drum 12 is rotated to the home position and stopped there. After the print drum 12, press roller 159, cleaning roller 165 and sheet take-up member 169 have stopped, the printer 1 again waits in the stand-by state.

When the operator, confirmed the position, density and so forth of the images formed by trial printing, inputs a desired number of prints on the numeral keys 109 and then presses the print start key 105, the illustrative embodiment executes the printing operation like the previous embodiments. In the illustrative embodiment, the desired number of prints is also assumed to be N.

When the print start key 105 is pressed, the camshaft 44 is moved to the position where the cam plate 138B is capable of contacting the cam follower 41 as during the master sticking operation and trial printing operation, and then the press roller locking means is caused to stop operating. The print drum 12 is driven at the desired printing speed while the path selector 10 is switched to the second position. After the start of rotation of the print drum 12, one sheet P1 is fed from the sheet feeding section 4 while the press roller 159 is driven to rotate. As a result, an image corresponding to the first image 65A of the master 65 is printed on the front side of the sheet P1 in the printing section 2. The sheet P1 carrying the image is steered by the path selector 10 toward the auxiliary tray 8 and then stopped with its leading edge abutting against the end portion 24*a*.

Subsequently, the press roller locking means is operated to lock the press roller 159 in the released position while the press roller drive motor 145 is deenergized. The cam shaft 44 is shifted to the position where the cam plate 138A is capable of contacting the cam follower 41. Subsequently, the press roller drive motor 145 is energized while the press roller locking means is caused to stop operating. At substantially the same time as this operation, the second sheet P2 is fed from the sheet feeding section 4, stopped by the registration roller pair 71, and then conveyed toward the printing section 2 at the same timing as the first sheet P1. The path selector 10 is switched to the first position before the damper 19 again faces the path selector 10 and again switched to the second position after the passage of the damper 19.

The sheet P2 is then pressed against the first image 65A of the master 65 by the press roller 136, so that a corresponding image is printed on the front side of the sheet P2. The sheet P2 with such an image is steered by the path selector 10 held in the second position toward the auxiliary tray 8. At this instant, the solenoid 33 is operated at the same timing as during the trial printing operation and causes the sheet P1 staying on the auxiliary tray 8 to be conveyed toward the printing section 2 by the press roller 159. After the trailing edge of the sheet P2 has moved away from the nip between the press roller 159 and the print drum 12, the sheet P1 is conveyed to the above nip at the time when the reverse zone of the print drum 12 faces the press roller 159. The sheet P1 is then pressed against the second image 65B of the master 65 by the press roller 159, so that a corresponding image is printed on the reverse side of the sheet P1.

During the above operation, just before the intermediate zone of the print drum 12 faces the press roller 136, the solenoid 123 is energized to switch the path selector 10 from the second position to the first position. Consequently, the trailing edge of the sheet P2 being guided by the path selector 10 is brought to the auxiliary tray 8 via a small gap between the bottom 10*a* of the path selector 10 and the press roller 159. The trailing edge of the sheet P1 following the sheet P2 is guided toward the sheet conveying member 85 along the top 10*b* of the path selector 10. The sheet P1 is peeled off from the master 65 by the peeler 84 and then conveyed to the print tray 86 by the sheet conveying member 85.

When the press roller 159 completes one rotation after the turn-on of the solenoid 33, the solenoid 33 and solenoids 171 are turned off with the result that the refeed registration roller 23 and cleaning roller 165 are brought to the released position and contact position, respectively. Subsequently, when the press roller 159 completes one rotation after the start of rotation of the cleaning roller 165 effected by the cleaning roller drive motor, the press roller drive motor 145 is deenergized while the solenoids 171 are energized to move the cleaning roller 165 to the released position. At this time, the take-up motor is energized to feed the cleaning sheet 172 contacting the cleaning roller 165 in rotation by the preselected amount. Thereafter, the cleaning roller drive motor and take-up motor are deenergized.

Subsequently, the third sheet P3 is fed from the sheet feeding section 4, stopped by the registration roller pair 71, and then conveyed toward the printing section 2 at the same timing as the sheet P1. The path selector 10 is located at the first position in order to avoid the clamper 19 and then located at the second position. After an image corresponding to the first image 65A has been printed on the front side of the sheet P3, the sheet P3 is steered by the path selector 10 toward the auxiliary tray 8. Subsequently, the solenoid 33 is energized at the preselected timing to convey the sheet P2 staying on the auxiliary tray 8 toward the printing section 2. The sheet P2 reaches the nip between the print drum 12 and the press roller 159 at the same timing as the sheet P1, so that an image corresponding to the second image 65B is printed on the reverse side of the sheet P2. The path selector 10 is switched from the second position to the first position at the previously stated timing to thereby guide the trailing edge of the sheet P3 toward the auxiliary tray 8 via the small gap between the bottom 10*a* of the path selector 10 and the press roller 159. Thereafter, the leading edge of the sheet P2 conveyed from the auxiliary tray 8 is guided toward the sheet conveying member 85 along the top 10*b* of the path selector 10. The sheet P2 is then peeled off from the master. 65 by the peeler 84 and conveyed to the print tray 86 by the sheet conveying member 85.

During the above operation, the solenoid 33 and solenoids 171 each are deenergized at the previously stated timing, so that the refeed registration roller 23 and cleaning roller 165 are brought to the released position and contact position, respectively. Subsequently, the press roller drive motor 145 is deenergized at the previously stated timing while, at the same time, the solenoids 171 are energized to cause the sheet take-up member 169 to take up the cleaning sheet 173. The procedure to follow is the same up to the end of rotation of the sheet take-up member 169.

The procedure described above is repeated up to the "N−1" print. The "N" sheet PN is fed from the sheet feeding section 4, formed with an image corresponding to the first image 65A on its front side, and then guided to the auxiliary tray 8. Subsequently, the "N−1" sheet P (N−1) is formed with an image corresponding to the second image 65B on its reverse side and then driven out to the print tray 86. Thereafter, the press roller locking means is operated to lock the press roller 159 at the released position while the press roller drive motor 145 is deenergized. The cam shaft 44 is therefore shifted to the position where the cam plate 138C is capable of contacting the cam follower 41. Subsequently, the press roller drive motor 145 is again energized while the press roller locking means is caused to stop operating; the path selector 10 is held in the first position.

At a timing slightly earlier than the time when the leading edge of the second image 65B in the direction of drum rotation arrives at the press roller 159, the solenoid 33 is energized to move the arm 32 clockwise, as viewed in FIG. 9, about the shaft 32*a*. As a result, the refeed registration roller 23 is moved from the released position to the contact position and presses the sheet PN held stationary with its leading edge abutting against the end portion 24*a* against the press roller 159, which is being driven by the press roller drive motor 145. Thereafter, at a timing when the leading edge of the second image 65B arrives at the press roller 159, the projection of the cam plate 138C is released from the cam follower 41, causing the press roller 159 to contact the print drum 12 under the action of the print pressure spring 42. Consequently, an image corresponding to the second image 65B is printed on the reverse side of the sheet PN The sheet PN carrying the images on both sides thereof is guided by the top 10*b* of the path selector 10 to the sheet conveying member 85, peeled off by the peeler 84, and conveyed to the print tray 86 by the sheet conveying member 85. Subsequently, the press roller 159, contacted the entire reverse zone of the print drum 12, is released from the print drum 12 because the projection of the cam plate 138C contacts the cam follower 41. At this instant, the press roller locking means is operated to hold the press roller 159 in the released position. At substantially the same time, the solenoid 33 and solenoids 171 are deenergized with the result that the refeed registration roller 23 and cleaning roller 165 are brought to the released position and contact position, respectively. The press roller drive motor 145 is deenergized at the previously stated timing while the solenoids 171 are energized. Subsequently, the take-up motor is driven to cause the sheet take-up roller 169 to take up the cleaning sheet 173. During this period of time, the print drum 12 is rotated to the home position and stopped there. After the print drum 12, press roller 159, cleaning roller 165 and sheet take-up member 169 have stopped, the printer 1 waits in the stand-by state.

As stated above, in the illustrative embodiment, the cleaning roller 165 is interposed between the refeed registration roller 23 and the refeed guide member 160, so that a wider space for the cleaning member 161 is available with the illustrative embodiment than with the previous embodiments. It is therefore possible to use a cleaning member with a high cleaning ability and therefore to obviate the retransfer of the ink from the press roller to the sheet more positively, thereby insuring attractive prints.

In the second and third embodiments shown and described, the press roller drive means 145, constituting the press roller drive means 139, causes the press roller 136 or 159 to rotate. Alternatively, the output torque of the drum drive means 121 may be transferred to the press roller 136 or 159 by drive transmitting means using, e.g., gears or a belt.

Figure 14:
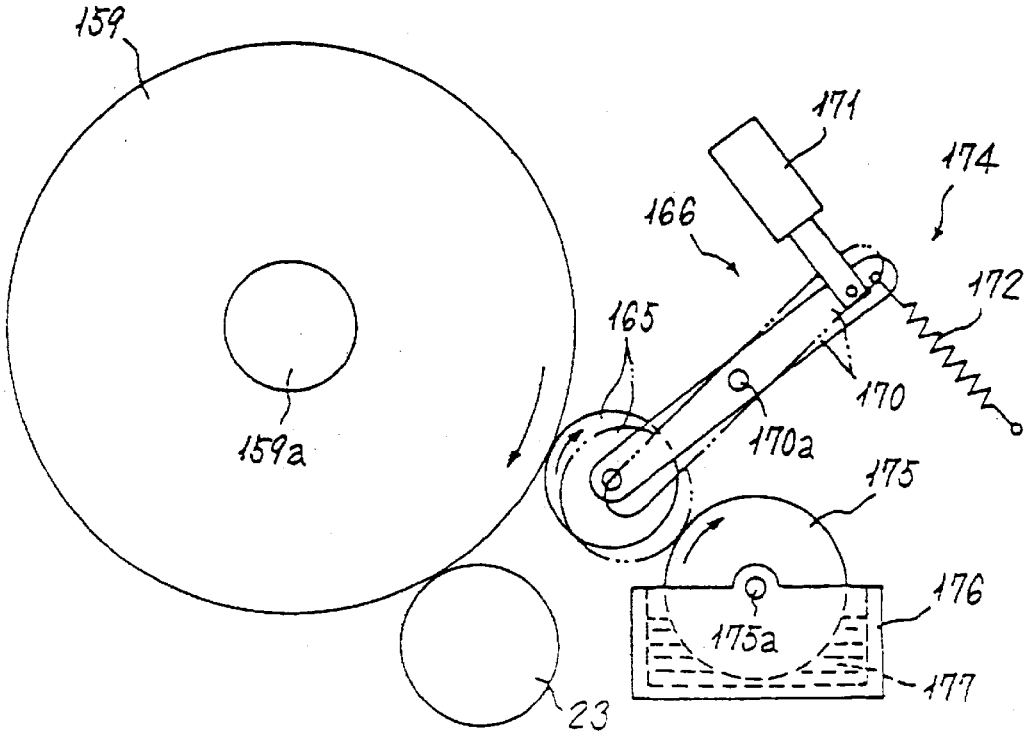
FIG. 14 shows a modified form of the cleaning member included in the third embodiment.

FIG. 14 shows a cleaning member 174 representative of a modification of the third embodiment. As shown, the cleaning member 174 differs from the cleaning member 161 in that a coating roller 175 and a cleaner storing member 176 are substituted for the wiping roller 167, roll holding member 168, sheet take-up member, and cleaning sheet 173.

The coating roller 175 is formed of a material resistant to corrosion ascribable to ink and resistant to a cleaner, e.g., sponge rubber based on silicone resin. The coating roller 175 has the same width as the cleaning roller 165. The shaft 175*a* of the coating roller 175 is journalled to the cleaner storing member 176. A coating roller drive motor, not shown, is mounted on one of the arms 20 and drives the coating roller 175 in a direction indicated by an arrow in FIG. 14 such that the roller 175 rotates at substantially the same peripheral speed as the cleaning roller 165.

The cleaner storing member 176 implemented as a box stores a cleaner liquid 177 therein and is mounted on a bracket, not shown, supported between the arms 20. The cleaner storing member 176 is positioned such that when the cleaning roller 165 is brought to the released position, the cleaning roller 165 and coating roller 175 are pressed against each other by preselected pressure. The cleaner liquid 177 may be implemented as a neutral detergent, alcohol, benzine, kerosene, gasoline or similar petroleum.

In operation, the cleaning roller moving means 166 presses the cleaning roller 165 against the coating roller 175. In this condition, the cleaning roller 165 and coating roller 175 are rotated in the same direction, so that the coating roller 175 impregnated with the cleaner liquid 177 cleans the surface of the cleaning roller 165. With this configuration, the modification achieves the same advantages as the third embodiment.

In the third embodiment and its modification, the circumferential length of the press roller 159 is simply greater than the circumferential direction of the front zone or the reverse zone of the print drum 12. Alternatively, use may be made of a press roller not only satisfying the above condition, but also having a circumferential length, i.e., a diameter whose ratio to the diameter of the print drum 12 is an integer. This makes it easy to equalize the peripheral speed of the press roller and that of the print drum 12 and allows the press roller to contact the print drum 12 at the same position without fail. It follows that the press roller does not have to be cleaned every time the print drum 12 makes one rotation as in the third embodiment, and therefore control is simplified. In this case, the circumferential length of the press roller must be greater than that of the reverse zone of the print drum 12, so that the diameter ratio of the press roller to the print drum 12 should preferably be 1:2 or 1:3. A ratio greater than 1:2 or 1:3 would excessively increase the diameter of the print drum 12 and would thereby obstruct the size reduction of the printer.

In the illustrative embodiments and their modifications, the refeed registration member for refeeding the sheet P, which carries images on its one side, from the auxiliary tray 8 is implemented as the freely rotatable, refeed registration roller 23 movable into and out of contact with the press roller 13, 136 or 159. Alternatively, the refeed registration member may be implemented as, e.g., a plate curved complementarily to the press roller 13, 136 or 159 and movable into and out of contact with the same.

In summary, it will be seen that the present invention provides a printer capable of producing simplex prints in the same manner a conventional stencil printer without wasting a stencil. Further, the printer of the present invention prints images on both sides of a sheet with ink transferred from a print drum by a press roller, insuring attractive prints. Moreover, the printer of the present invention is comparable in size and therefore in space to occupy with the conventional simplex printer.

Various modifications will become possible for those skilled in the art after receiving the teachings of the present disclosure without departing from the scope thereof.

What is claimed is:

1. A printer with a duplex printing capability, comprising:

a printing section comprising a print drum around which a master formed with a first and a second image side by side is to be wrapped and a press roller selectively movable into or out of contact with said print drum;

a sheet feeding section for feeding a sheet toward said printing section;

a sheet discharging section for discharging a printed sheet coming out of said printing section to an outside of said printer;

an auxiliary tray for temporarily stopping the printed sheet carrying an image on a front side thereof;

refeeding means for again feeding the printed sheet temporarily stopped by said auxiliary tray toward said printing section; and a path selector for selectively steering the sheet coming out of said printing section toward said auxiliary tray or said sheet discharging section;

wherein in a duplex print mode said printing section prints either one of the first image and the second image on a front side of a first sheet fed from said sheet feeding section, said path selector steers said first sheet coming out of said printing section toward said auxiliary tray, said printing section prints either one of said first image and said second image on a front side of a second sheet fed from said sheet feeding section while said refeeding means again feeds said first sheet to said printing section to thereby form either one of said first image and said second image on a reverse side of said first sheet, and said path selector steers said first sheet toward said sheet discharging section and steers said second sheet toward said auxiliary tray.

2. The printer as claimed in claim 1, wherein in a simplex print mode a master formed with a third image equal in area to a sum of the first image and the second image is wrapped around said print drum, said printing section prints said third image on a front side of a sheet fed from said sheet feeding section, and said path selector steers said sheet coming out of said printing section toward said sheet discharging section.

3. The printer as claimed in claim 1, wherein said refeeding means comprises:

a refeed conveying member for conveying the sheet with a printed front side toward said press roller;

a refeed positioning member for temporarily stopping the sheet with the printed front side conveyed by said refeed conveying member at a preselected position short of said press roller;

a refeed registration member for causing the sheet with the printed front side stopped at the preselected position to contact said press roller, which is rotating, at a preselected timing; and a refeed guide member for guiding the sheet with the printed front side, which is being conveyed by said press roller in contact with said press roller, toward said print drum by pressing said sheet against said press roller.

4. The printer as claimed in claim 3, wherein said auxiliary tray is positioned below said sheet discharging section.

5. The printer as claimed in claim 3, further comprising a press roller support member rotatably supporting said press roller;

a press roller moving mechanism for causing said press roller support member to angularly move such that said press roller selectively moves into or out of contact with said print drum;

a refeed registration support member supporting said refeed registration member;

said refeed registration support member being angularly movably supported by said press roller support member; and a refeed registration moving mechanism for causing said refeed registration support member to thereby selectively move said refeed registration member into or out of contact with said press roller.

6. The printer as claimed in claim 5, wherein said press roller moving mechanism releases, when said print drum makes a first one rotation, said press roller from said print drum to thereby prevent the other of the first image and the second image from contacting said press roller and releases, when said print drum makes a last one rotation, said press roller from said print drum to thereby prevent one of said first image and said second image from contacting said press roller.

7. The printer as claimed in claim 3, wherein said refeed guide member comprises a roller rotatably supported by said press roller support member and contacting said press roller.

8. The printer as claimed in claim 3, wherein said refeed guide member comprises two rollers and an endless belt passed over said two rollers and contacting said press roller, and said two rollers are rotatably supported by said press roller support member.

9. The printer as claimed in claim 3, wherein said refeed guide member comprises a plate member contacting said press roller and supported by said press roller support member.

10. The printer as claimed in claim 3, further comprising a cleaning member for cleaning a surface of said press roller.

11. The printer as claimed in claim 10, wherein said cleaning member is selectively movable into or out of contact with the surface of said press roller.

12. The printer as claimed in claim 11, wherein said cleaning member is released from the surface of said press roller in a simplex print mode.

13. The printer as claimed in claim 3, wherein said press roller is caused to rotate by press roller drive means at a substantially same speed as said print drum.

14. The printer as claimed in claim 13, wherein said press roller is caused to rotate by said print drum when contacting said print drum.

15. The printer as claimed in claim 13, wherein said press roller drive means comprises drive transmitting means for preventing, when said press roller is angularly moved, a phase from varying due to rotation of said press roller.

16. The printer as claimed in claim 15, wherein said press roller has a diameter that is one-half to one-third of a diameter of said print drum.

17. The printer as claimed in claim 13, further comprising a cleaning member for cleaning a surface of said press roller.

18. The printer as claimed in claim 17, wherein said cleaning member is selectively movable into or out of contact with the surface of said press roller.

19. The printer as claimed in claim 18, wherein said cleaning member is released from the surface of said press roller in a simplex print mode.

20. The printer as claimed in claim 18, wherein said cleaning member is positioned between said refeed registration member and said refeed guide member and is released from said press roller when the sheet with the printed front side is being conveyed by said refeed registration member.

21. The printer as claimed in claim 20, wherein said press roller has a circumferential length greater than a length of the first image or the second image.

22. The printer as claimed in claim 3, wherein a surface of said press roller is ink-repellent.

23. The printer as claimed in claim 3, further comprising first display means for displaying an alarm message when thick sheets are set at said sheet feeding section.

24. The printer as claimed in claim 3, further comprising second displaying means for displaying an alarm message when a size of the sheets set at said sheet feeding section and a size of each of the first image and the second image are not coincident.

25. The printer as claimed in claim 3, further comprising a master making section for selectively making the master with the first image and the second image or the master with the third image.

26. The printer as claimed in claim 25, wherein when making the master with the first image and the second image, said master making section forms a preselected blank portion between said first image and said second image.

27. The printer as claimed in claim 25, wherein said master making section makes the master with the first image and the second image such that one of said first image and said second image including more solid image portions than the other is printed on the reverse side of the sheet.

28. The printer as claimed in claim 25, wherein when image data input for master making in the duplex print mode is larger in size than each of the first image and the second image, an alarm message is output while a guidance indicative of rotation or reduction of said image data is output for promoting easy operation.

29. The printer as claimed in claim 25, wherein when making of the master with the first image and the second image and printing are repeated with image data continuously input in the duplex print mode to thereby produce a plurality of pages of duplex prints and when a number of the image data is odd, master making and printing are executed in a same manner as in the duplex copy mode with a blank page being added to a last page.

* * * * *

UNITED STATES PATENT AND TRADEMARK OFFICE

CERTIFICATE OF CORRECTION

PATENT NO. : 6,718,872 B2
DATED : April 13, 2004
INVENTOR(S) : Hiroshi Kanno

It is certified that error appears in the above-identified patent and that said Letters Patent is hereby corrected as shown below:

Column 2,
Line 30, change “dampers” to -- clampers --.

Column 4,
Lines 39 and 44, change “damper” to -- clamper --.

Column 5,
Line 32, change “pressure-.” to -- pressure. --.

Column 9,
Line 6, change “57” to -- 58 --.

Column 11,
Lines 7 and 53, change “damper” to -- clamper --.

Column 14,
Lines 12, 15, 48 and 51, change “damper” to -- clamper --.

Column 16,
Line 3, “printer. 1” to -- printer 1 --.

Column 17,
Lines 44 and 45, change “damper” to -- clamper --.

Column 18,
Line 12, change “maybe” to -- may be --.
Line 49, change “damper” to -- clamper --.

Column 20,
Line 22, change “damper” to -- clamper --.
Line 65, change “camshaft” to -- cam shaft --.

Column 21,
Line 27, change “damper” to -- clamper --.

Column 22,
Line 24, change “camshaft” to -- cam shaft --.

UNITED STATES PATENT AND TRADEMARK OFFICE

CERTIFICATE OF CORRECTION

PATENT NO. : 6,718,872 B2
DATED : April 13, 2004
INVENTOR(S) : Hiroshi Kanno

It is certified that error appears in the above-identified patent and that said Letters Patent is hereby corrected as shown below:

Column 26,
Line 55, change “damper” to -- clamper --.

Column 27,
Line 56, change “damper” to -- clamper --.

Column 28,
Lines 45 and 47, change “damper” to -- clamper --.

Column 33,
Line 48, change “damper” to -- clamper --.

Column 35,
Line 38, change “camshaft” to -- cam shaft --.
Lines 65 and 67, change “damper” to -- clamper --.

Signed and Sealed this

Third Day of August, 2004

JON W. DUDAS
*Acting Director of the United States Patent and Trademark Office*